US011679292B2

(12) United States Patent
Liu et al.

(10) Patent No.: US 11,679,292 B2
(45) **Date of Patent: *Jun. 20, 2023**

(54) CATIONIC SURFACTANT FOAM STABILIZING COMPOSITION

(71) Applicants: DOW SILICONES CORPORATION, Midland, MI (US); DOW GLOBAL TECHNOLOGIES LLC, Midland, MI (US)

(72) Inventors: Nanguo Liu, Midland, MI (US); Zachary Wenzlick, Midland, MI (US); Brian Harkness, Midland, MI (US); Jon Hannington, Midland, MI (US); Scott Miller, Midland, MI (US); Gerald Witucki, Midland, MI (US); Brian Dorvel, Midland, MI (US)

(73) Assignees: DOW SILICONES CORPORATION, Midland, MI (US); DOW GLOBAL TECHNOLOGIES LLC, Midland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/789,175

(22) PCT Filed: Dec. 22, 2020

(86) PCT No.: PCT/US2020/066605

§ 371 (c)(1),
(2) Date: Jun. 25, 2022

(87) PCT Pub. No.: WO2021/138147

PCT Pub. Date: Jul. 8, 2021

(65) Prior Publication Data

US 2023/0095031 A1 Mar. 30, 2023

Related U.S. Application Data

(60) Provisional application No. 62/955,145, filed on Dec. 30, 2019.

(51) Int. Cl.
*A62D 1/02* (2006.01)
*A62C 99/00* (2010.01)

(52) U.S. Cl.
CPC ..... *A62D 1/0071* (2013.01); *A62C 99/0036* (2013.01)

(58) Field of Classification Search
CPC ..... C09K 23/54
See application file for complete search history.

(56) References Cited

U.S. PATENT DOCUMENTS

| | | | |
|---|---|---|---|
| 3,677,347 | A | 7/1972 | Rosen et al. |
| 4,149,978 | A | 4/1979 | Goffinet |
| 7,569,155 | B2 | 8/2009 | Schaefer |
| 2005/0164900 | A1 | 7/2005 | Masschelein et al. |
| 2008/0196908 | A1 | 8/2008 | Schaefer |

FOREIGN PATENT DOCUMENTS

| | | |
|---|---|---|
| EP | 0043622 A1 | 1/1982 |
| EP | 3328977 A1 | 6/2018 |

OTHER PUBLICATIONS

Shishatskiy et al. "Quaternary ammonium membrane materials for CO2 separation" Journal of Membrane Science, 2010, 359, 44-53. (Year: 2010).*

Snow, Steven A. "Synthesis, characterization, stability, aqueous surface activity, and aqueous solution aggregation of the novel, cationic siloxane surfactants (Me3SiO) 2Si (Me)—(CH2) 3+ NMe2 (CH2) 2OR X-(R=hydrogen, acetyl, N-phenylcarbamyl; X=chloride, bromide, iodide, nitrate, methyl sulfate)." Langmuir 9.2 (1993): 424-430.

Schmaucks, G., et al. "Effect of siloxanyl groups on the interfacial behavior of quaternary ammonium compounds." Langmuir 8.7 (1992): 1724-1730.

International Search Report for PCT/US2020/066605 dated May 20, 2021, 4 pages.

* cited by examiner

*Primary Examiner* — Peter F Godenschwager

(74) *Attorney, Agent, or Firm* — Warner Norcross + Judd LLP

(57) ABSTRACT

A foam stabilizing composition is disclosed. The composition comprises (A) a siloxane cationic surfactant comprising a cationic moiety having the formula $Z^1$-$D^1$-$N(Y)_a(R)_{2-a}$, wherein $Z^1$ is a siloxane moiety, $D^1$ is a divalent linking group, R is H or an unsubstituted hydrocarbyl group having from 1 to 4 carbon atoms, subscript a is 1 or 2, and each Y has formula -D-$NR^1{}_3$+, where D is a divalent linking group and each $R^1$ is independently an unsubstituted hydrocarbyl group having from 1 to 4 carbon atoms. The composition also comprises (B) an organic cationic surfactant comprising a cationic moiety having the formula $Z^2$-$D^2$-$N(Y)_b(R)_{2-b}$, wherein $Z^2$ is an unsubstituted hydrocarbyl group, $D^2$ is a covalent bond or a divalent linking group, subscript b is 1 or 2, and R, Y, and subscript a, are defined above. An aqueous film-forming foam comprising the composition and method of using the same are also disclosed.

18 Claims, No Drawings

CATIONIC SURFACTANT FOAM STABILIZING COMPOSITION

CROSS-REFERENCE TO RELATED APPLICATIONS

This application is the U.S. National Stage of International Application No. PCT/US2020/066605 filed on 22 Dec. 2020, which claims priority to and all advantages of U.S. Provisional Patent Application No. 62/955,145 filed on 30 Dec. 2019, the content of which is incorporated herein by reference.

FIELD OF THE INVENTION

The present disclosure relates generally to foam compositions and, more specifically, to a foam stabilizing composition, an aqueous film-forming foam composition comprising the same, and a methods of preparing and using the same.

DESCRIPTION OF THE RELATED ART

Surfactants and surfactant compositions are known in the art and are utilized in myriad end use applications and environments. In particular, surfactants and surfactant compositions are utilized in numerous industrial, commercial, home care, and personal care formulations. As but one example, surfactants and surfactant compositions are commonly utilized in the preparation of a wide variety of surface treatments and coating compositions, e.g. to influence the characteristics of the compositions themselves as well as to provide surface effects to substrates threated with such surface treatment/coating compositions. For example, polyfluoroalkyl-based surfactants and compositions thereof have been widely employed in industrial compositions as fume suppressants and etching additives, in surface treatments for imparting water and oil repellency to the surface of articles such as carpeting, upholstery, apparel, textiles, etc., as well as in many commercial products such as cleaning compositions, waxes, sealants, and foams. Additionally, polyfluoroalkyl-based surfactants have been utilized in numerous conventional aqueous film-forming foams (AFFFs), which have previously enjoyed widespread use in preventing, containing, and/or extinguishing fires.

Unfortunately, however, polyfluoroalkyl-based surfactants have been shown to decompose or otherwise degrade under environmental conditions to give numerous fluorochemicals, some of which have been found to be environmentally persistent due to many of the desired properties of such compounds that resulted in their wide-spread use (e.g. high chemical resistance, wide chemical compatibility, high lipophobicity, etc.). As such, polyfluoroalkyl-based surfactants are increasingly being phased out of production and use, leading to many widely utilized surfactants and surfactant compositions becoming unavailable for continued use.

BRIEF SUMMARY

The present disclosure provides a foam stabilizing composition. The foam stabilizing composition comprises (A) a siloxane cationic surfactant and (B) an organic cationic surfactant. The siloxane cationic surfactant (A) has the general formula (I):

$$[Z^1\text{-}D^1\text{-}N(Y)_a(R)_{2-a}]^{+y}[X^{-x}]_n \quad \text{(I)},$$

wherein $Z^1$ is a siloxane moiety; $D^1$ is a divalent linking group; R is H or an unsubstituted hydrocarbyl group having from 1 to 4 carbon atoms; each Y has formula $\text{-D-NR}^1{}_3\text{+}$, where D is a divalent linking group and each $R^1$ is independently an unsubstituted hydrocarbyl group having from 1 to 4 carbon atoms; subscript a is 1 or 2; $1 \le y \le 3$; X is an anion; subscript n is 1, 2, or 3; and $1 \le x \le 3$, with the proviso that $(x*n)=y$. The organic cationic surfactant (B) has the general formula (II):

$$[Z^2\text{-}D^2\text{-}N(Y)_b(R)_{2-b}]^{+y}[X^{-x}]_n \quad \text{(II)},$$

wherein $Z^2$ is an unsubstituted hydrocarbyl group; $D^2$ is a covalent bond or a divalent linking group; subscript b is 1 or 2; and each R, Y, superscript y, X, subscript n, and superscript x is independently selected and as defined above.

The present disclosure also provides a method of preparing the foam stabilizing composition.

The present disclosure further provides an aqueous film-forming foam (AFFF) comprising the foam stabilizing composition, and methods relating to preparing and using the same.

DETAILED DESCRIPTION

A foam stabilizing composition (the "composition") is provided. The composition may be utilized in foam compositions (i.e., foams), including aqueous foaming compositions, expanded foam compositions, concentrated foam compositions and/or foam concentrates, etc., which may be formulated and/or utilized in diverse end-use applications. For example, as will be appreciated from this disclosure, the composition may be utilized in an aqueous film-forming foam (AFFF) or similar foaming composition suitable for use in extinguishing, suppressing, and/or preventing fire.

The composition comprises (A) a siloxane cationic surfactant and (B) an organic cationic surfactant. The siloxane cationic surfactant (A) and organic cationic surfactant (B) are described in turn below, along with additional/optional components that may be utilized in the composition, which may be individually referred to herein as "component (A)", "component (B)", etc., respectively, and collectively as the "components" of the composition.

As introduced above, component (A) of the composition is a siloxane cationic surfactant, i.e., a complex comprising a cationic organosilicon compound charge-balanced with a counter ion. In particular, the siloxane cationic surfactant (A) comprises a siloxane moiety and one or more quaternary ammonium moieties, and conforms to general formula (I):

$$[Z^1\text{-}D^1\text{-}N(Y)_a(R)_{2-a}]^{+y}[X^{-x}]_n \quad \text{(I)},$$

wherein $Z^1$ is a siloxane moiety; $D^1$ is a divalent linking group; R is H or an unsubstituted hydrocarbyl group having from 1 to 4 carbon atoms; each Y has formula $\text{-D-NR}^1{}_3\text{+}$, where D is a divalent linking group and each $R^1$ is independently an unsubstituted hydrocarbyl group having from 1 to 4 carbon atoms; subscript a is 1 or 2; $1 \le y \le 3$; X is an anion; subscript n is 1, 2, or 3; and $1 \le x \le 3$, with the proviso that $(x*n)=y$.

With regard to formula (I), as introduce above, $Z^1$ represents a siloxane moiety. In general, the siloxane moiety $Z^1$ comprises a siloxane and is otherwise not particularly limited. As understood in the art, siloxanes comprise an inorganic silicon-oxygen-silicon group (i.e., —Si—O—Si—), with organosilicon and/or organic side groups attached to the silicon atoms. As such, siloxanes may be represented by the general formula $([R^x{}_iSiO_{(4-i)/2}]_h)_j(R^x)_{3-j}Si$—, where subscript i is independently selected from 1, 2, and 3 in each moiety indicated by subscript h, subscript h is at least 1, subscript j is 1, 2, or 3, and each $R^x$ is independently selected from hydrocarbyl groups, alkoxy and/or aryloxy groups, and siloxy groups.

Hydrocarbyl groups suitable for $R^x$ include monovalent hydrocarbon moieties, as well as derivatives and modifications thereof, which may independently be substituted or unsubstituted, linear, branched, cyclic, or combinations thereof, and saturated or unsaturated. With regard to such hydrocarbyl groups, the term "unsubstituted" describes hydrocarbon moieties composed of carbon and hydrogen atoms, i.e., without heteroatom substituents. The term "substituted" describes hydrocarbon moieties where either at least one hydrogen atom is replaced with an atom or group other than hydrogen (e.g. a halogen atom, an alkoxy group, an amine group, etc.) (i.e., as a pendant or terminal substituent), a carbon atom within a chain/backbone of the hydrocarbon is replaced with an atom other than carbon (e.g. a heteroatom, such as oxygen, sulfur, nitrogen, etc.) (i.e., as a part of the chain/backbone), or both. As such, suitable hydrocarbyl groups may comprise, or be, a hydrocarbon moiety having one or more substituents in and/or on (i.e., appended to and/or integral with) a carbon chain/backbone thereof, such that the hydrocarbon moiety may comprise, or be, an ether, an ester, etc. Linear and branched hydrocarbyl groups may independently be saturated or unsaturated and, when unsaturated, may be conjugated or nonconjugated. Cyclic hydrocarbyl groups may independently be monocyclic or polycyclic, and encompass cycloalkyl groups, aryl groups, and heterocycles, which may be aromatic, saturated and nonaromatic and/or non-conjugated, etc. Examples of combinations of linear and cyclic hydrocarbyl groups include alkaryl groups, aralkyl groups, etc. General examples of hydrocarbon moieties suitably for use in or as the hydrocarbyl group include alkyl groups, aryl groups, alkenyl groups, alkynyl groups, halocarbon groups, and the like, as well as derivatives, modifications, and combinations thereof. Examples of alkyl groups include methyl, ethyl, propyl (e.g. iso-propyl and/or n-propyl), butyl (e.g. isobutyl, n-butyl, tert-butyl, and/or sec-butyl), pentyl (e.g. isopentyl, neopentyl, and/or tert-pentyl), hexyl, and the like (i.e., other linear or branched saturated hydrocarbon groups, e.g. having greater than 6 carbon atoms). Examples of aryl groups include phenyl, tolyl, xylyl, naphthyl, benzyl, dimethyl phenyl, and the like, as well as derivatives and modifications thereof, which may overlap with alkaryl groups (e.g. benzyl) and aralkyl groups (e.g. tolyl, dimethyl phenyl, etc.). Examples of alkenyl groups include vinyl, allyl, propenyl, isopropenyl, butenyl, isobutenyl, pentenyl, heptenyl, hexenyl, cyclohexenyl groups, and the like, as well as derivatives and modifications thereof. General examples of halocarbon groups include halogenated derivatives of the hydrocarbon moieties above, such as halogenated alkyl groups (e.g. any of the alkyl groups described above, where one or more hydrogen atoms is replaced with a halogen atom such as F or Cl), aryl groups (e.g. any of the aryl groups described above, where one or more hydrogen atoms is replaced with a halogen atom such as F or Cl), and combinations thereof. Examples of halogenated alkyl groups include fluoromethyl, 2-fluoropropyl, 3,3,3-trifluoropropyl, 4,4,4-trifluorobutyl, 4,4,4,3,3-pentafluorobutyl, 5,5,5,4,4,3,3-heptafluoropentyl, 6,6,6,5,5,4,4,3,3-nonafluorohexyl, and 8,8,8,7,7-pentafluorooctyl, 2,2-difluorocyclopropyl, 2,3-difluorocyclobutyl, 3,4-difluorocyclohexyl, 3,4-difluoro-5-methylcycloheptyl, chloromethyl, chloropropyl, 2-dichlorocyclopropyl, 2,3-dichlorocyclopentyl, and the like, as well as derivatives and modifications thereof. Examples of halogenated aryl groups include chlorobenzyl, pentafluorophenyl, fluorobenzyl groups, and the like, as well as derivatives and modifications thereof.

Alkoxy and aryloxy groups suitable for $R^x$ include those having the general formula —$OR^{xi}$, where $R^{xi}$ is one of the hydrocarbyl groups set forth above with respect to $R^x$. Examples of alkoxy groups include methoxy, ethoxy, propoxy, butoxy, benzyloxy, and the like, as well as derivatives and modifications thereof. Examples of aryloxy groups include phenoxy, tolyloxy, pentafluorophenoxy, and the like, as well as derivatives and modifications thereof.

Examples of suitable siloxy groups suitable for $R^x$ include [M], [D], [T], and [Q] units, which, as understood in the art, each represent structural units of individual functionality present in siloxanes, such as organosiloxanes and organopolysiloxanes. More specifically, [M] represents a monofunctional unit of general formula $R^{xii}{}_3SiO_{1/2}$; [D] represents a difunctional unit of general formula $R^{xii}{}_2SiO_{2/2}$; [T] represents a trifunctional unit of general formula $R^{xii}SiO_{3/2}$; and [Q] represents a tetrafunctional unit of general formula $SiO_{4/2}$, as shown by the general structural moieties below:

[M]

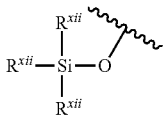

[D]

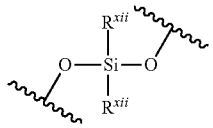

[T]

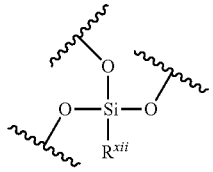

[Q]

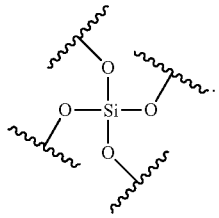

In these general structural moieties, each $R^{xii}$ is independently a monovalent or polyvalent substituent. As understood in the art, specific substituents suitable for each $R^{xii}$ are not limited, and may be monoatomic or polyatomic, organic or inorganic, linear or branched, substituted or unsubstituted, aromatic, aliphatic, saturated or unsaturated, and combinations thereof. Typically, each $R^{xii}$ is independently selected from hydrocarbyl groups, alkoxy and/or aryloxy groups, and siloxy groups. As such, each $R^{xii}$ may independently be a hydrocarbyl group of formula —$R^{xi}$ or an alkoxy or aryloxy group of formula —$OR^{xi}$, where $R^{xi}$ is as defined above, or a siloxy group represented by any one, or combination, of [M], [D], [T], and/or [Q] units described above.

The siloxane moiety $Z^1$ may be linear, branched, or combinations thereof, e.g. based on the number and arrangement of [M], [D], [T], and/or [Q] siloxy units present therein. When branched, the siloxane moiety $Z^1$ may minimally branched or, alternatively, may be hyperbranched and/or dendritic.

In certain embodiments, the siloxane moiety $Z^1$ is a branched siloxane moiety having the formula $—Si(R^3)_3$, wherein at least one $R^3$ is $—OSi(R^4)_3$ and each other $R^3$ is independently selected from $R^2$ and $—OSi(R^4)_3$, where each $R^4$ is independently selected from $R^2$, $—OSi(R^5)_3$, and $—[OSiR^2{}_2]_mOSiR^2{}_3$. With regard to these selections for $R^4$, each $R^5$ is independently selected from $R^2$, $—OSi(R^6)_3$, and $—[OSiR^2{}_2]_mOSiR^2{}_3$, and each $R^6$ is independently selected from $R^2$ and $—[OSiR^2{}_2]_mOSiR^2{}_3$. In each selection, $R^2$ is an independently selected substituted or unsubstituted hydrocarbyl group, such as any of those described above with respect to $R^x$, and each subscript m is individually selected such that $0 \leq m \leq 100$ (i.e., in each selection where applicable).

As introduced above, each $R^3$ is selected from $R^2$ and $—OSi(R^4)_3$, with the proviso that at least one $R^3$ is of formula $—OSi(R^4)_3$. In certain embodiments, at least two of $R^3$ are of formula $—OSi(R^4)_3$. In specific embodiments, each $R^3$ is of formula $—OSi(R^4)_3$. It will be appreciated that a greater number of $R^3$ being $—OSi(R^4)_3$ increases the level of branching in the siloxane moiety $Z^1$. For example, when each $R^3$ is $—OSi(R^4)_3$, the silicon atom to which each $R^3$ is bonded is a T siloxy unit. Alternatively, when two of $R^3$ are of formula $OSi(R^4)_3$, the silicon atom to which each $R^3$ is bonded is a [D] siloxy unit. Moreover, when $R^3$ is of formula $—OSi(R^4)_3$, and when $R^4$ is of formula $—OSi(R^5)_3$, further siloxane bonds and branching are present in the siloxane moiety $Z^1$. This is further the case when $R^5$ is of formula $—OSi(R^6)_3$. As such, it will be understood by those of skill in the art that each subsequent $R^{3+n}$ moiety in the siloxane moiety $Z^1$ can impart a further generation of branching, depending on the particular selections thereof. For example, $R^4$ can be of formula $—OSi(R^5)_3$, and $R^5$ can be of formula $—OSi(R^6)_3$. Thus, depending on a selection of each substituent, further branching attributable to [T] and/or [Q] siloxy units may be present in the siloxane moiety $Z^1$ (i.e., beyond those of other substituents/moieties described above).

Each $R^4$ is selected from $R^2$, $—OSi(R^5)_3$, and $—[OSiR^2{}_2]_mOSiR^2{}_3$, where $0 \leq m \leq 100$. Depending on a selection of $R^4$ and $R^5$, further branching can be present in the siloxane moiety $Z^1$. For example, when each $R^4$ is $R^2$, then each $—OSi(R^4)_3$ moiety (i.e., each $R^3$ of formula $—OSi(R^4)_3$) is a terminal [M] siloxy unit. Said differently, when each $R^3$ is $—OSi(R^4)_3$, and when each $R^4$ is $R^2$, then each $R^3$ can be written as $—OSiR^2{}_3$ (i.e., an [M] siloxy unit). In such embodiments, the siloxane moiety $Z^1$ includes a [T] siloxy unit bonded to group D in formula (I), which [T] siloxy unit is capped by three [M] siloxy units. Moreover, when of formula $—[OSiR^2{}_2]_mOSiR^2{}_3$, $R^4$ includes optional [D] siloxy units (i.e., those siloxy units in each moiety indicated by subscript m) as well as an [M] siloxy unit (i.e., represented by $OSiR^2{}_3$). As such, when each $R^3$ is of formula $—OSi(R^4)_3$ and each $R^4$ is of formula $—[OSiR^2{}_2]_mOSiR^2{}_3$, then each $R^3$ includes a [Q] siloxy unit. More specifically, in such embodiments, each $R^3$ is of formula $—OSi([OSiR^2{}_2]_mOSiR^2{}_3)_3$, such that when each subscript m is 0, each $R^3$ is a [Q] siloxy unit endcapped with three [M] siloxy units. Likewise, when subscript m is greater than 0, each $R^3$ includes a linear moiety (i.e., a diorganosiloxane moiety) with a degree of polymerization being attributable to subscript m.

As set forth above, each $R^4$ can also be of formula $—OSi(R^5)_3$. In embodiments where one or more $R^4$ is of formula $—OSi(R^5)_3$, further branching can be present in the siloxane moiety $Z^1$ depending a selection of $R^5$. More specifically, each $R^5$ is selected from $R^2$, $—OSi(R^6)_3$, and $—[OSiR^2{}_2]_mOSiR^2{}_3$, where each $R^6$ is selected from $R^2$ and $—[OSiR^2{}_2]_mOSiR^2{}_3$, and where each subscript m is defined above.

Subscript m is from (and including) 0 to 100, alternatively from 0 to 80, alternatively from 0 to 60, alternatively from 0 to 40, alternatively from 0 to 20, alternatively from 0 to 19, alternatively from 0 to 18, alternatively from 0 to 17, alternatively from 0 to 16, alternatively from 0 to 15, alternatively from 0 to 14, alternatively from 0 to 13, alternatively from 0 to 12, alternatively from 0 to 11, alternatively from 0 to 10, alternatively from 0 to 9, alternatively from 0 to 8, alternatively from 0 to 7, alternatively from 0 to 6, alternatively from 0 to 5, alternatively from 0 to 4, alternatively from 0 to 3, alternatively from 0 to 2, alternatively from 0 to 1, alternatively is 0. In certain embodiments, each subscript m is 0, such that the siloxane moiety $Z^1$ is tree from D siloxy units.

Importantly, each of $R^2$, $R^3$, $R^4$, $R^5$, and $R^6$ are independently selected. As such, the descriptions above relating to each of these substituents is not meant to mean or imply that each substituent is the same. Rather, any description above relating to $R^4$, for example, may relate to only one $R^4$ or any number of $R^4$ in the siloxane moiety $Z^1$, and so on. In addition, different selections of $R^2$, $R^3$, $R^4$, $R^5$, and $R^6$ can result in the same structures. For example, if $R^3$ is $—OSi(R^4)_3$, and if each $R^4$ is $—OSi(R^5)_3$, and if each $R^5$ is $R^2$, then $R^3$ can be written as $—OSi(OSiR^2{}_3)_3$. Similarly, if $R^3$ is $—OSi(R^4)_3$, and if each $R^4$ is $—[OSiR^2{}_2]_mOSiR^2{}_3$, $R^3$ can be written as $—OSi(OSiR^2{}_3)_3$ when subscript m is 0. As shown, these particular selections result in the same final structure for $R^3$, based on different selections for $R^4$. To that end, any proviso of limitation on final structure of the siloxane moiety $Z^1$ is to be considered met by an alternative selection that results in the same structure required in the proviso.

In certain embodiments, each $R^2$ is an independently selected alkyl group. In some such embodiments, each $R^2$ is an independently selected alkyl group having from 1 to 10, alternatively from 1 to 8, alternatively from 1 to 6, alternatively from 1 to 4, alternatively from 1 to 3, alternatively from 1 to 2 carbon atom(s).

In particular embodiments, each subscript m is 0 and each $R^2$ is methyl, and the siloxane moiety $Z^1$ has one of the following structures (i)-(iv):

(i)

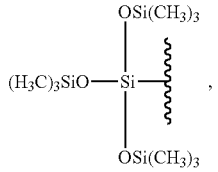

(ii)

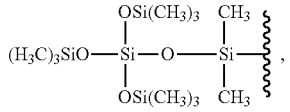

-continued (iii)

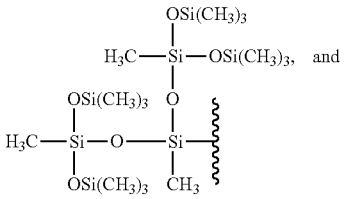

(iv)

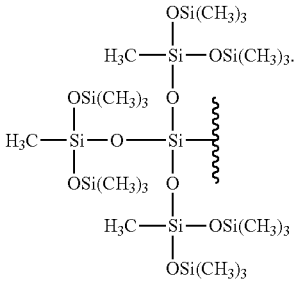

With further regard to the cationic surfactant and formula (I), as introduced above, $D^1$ a divalent linking group. The divalent linking group $D^1$ is not particularly limited. Typically, divalent linking group $D^1$ is selected from divalent hydrocarbon groups. Examples of such hydrocarbon groups include divalent forms of the hydrocarbyl and hydrocarbon groups described above, such as any of those set forth above with respect to $R^x$. As such, it will be appreciated that suitable hydrocarbon groups for the divalent linking group $D^1$ may be substituted or unsubstituted, and linear, branched, and/or cyclic.

In some embodiments, divalent linking group $D^1$ comprises, alternatively is a linear or branched alkyl and/or alkylene group. In certain embodiments, divalent linking group $D^1$ comprises, alternatively is, a $C_1$-$C_{18}$ hydrocarbon moiety, such as a linear hydrocarbon moiety having the formula —$(CH_2)_d$—, where subscript d is from 1 to 18. In some such embodiments, subscript d is from 1 to 16, such as from 1 to 12, alternatively from 1 to 10, alternatively from 1 to 8, alternatively from 1 to 6, alternatively from 2 to 6, alternatively from 2 to 4. In particular embodiments, subscript d is 3, such that divalent linking group $D^1$ comprises a propylene (i.e., a chain of 3 carbon atoms). As will be appreciated by those of skill in the art, each unit represented by subscript d is a methylene unit, such that linear hydrocarbon moiety may be defined or otherwise referred to as an alkylene group. It will also be appreciated that each methylene group may independently be unsubstituted and unbranched, or substituted (e.g. with a hydrogen atom replaced with a non-hydrogen atom or group) and/or branched (e.g. with a hydrogen atom replaced with an alkyl group). In certain embodiments, divalent linking group $D^1$ comprises, alternatively is, an unsubstituted alkylene group. In other embodiments, divalent linking group $D^1$ comprises, alternatively is, a substituted hydrocarbon group, such as a substituted alkylene group. In such embodiments, for example, divalent linking group $D^1$ typically comprises a carbon backbone having at least 2 carbon atoms and at least one heteroatom (e.g. O, N, S, etc.), such that the backbone comprises an ether moiety, amine moiety, etc.

In particular embodiments, divalent linking group $D^1$ comprises, alternatively is, an amino substituted hydrocarbon group (i.e., a hydrocarbon comprising a nitrogen-substituted carbon chain/backbone). For example, in some such embodiments, the divalent linking group $D^1$ is an amino substituted hydrocarbon having formula -$D^3$-N($R^7$)-$D^3$-, such that the siloxane cationic surfactant (A) may be represented by the following formula:

$$[Z^1\text{-}D^3\text{-}N(R^7)\text{-}D^3\text{-}N(Y)_a(R)_{2-a}]^{+y}[X^{-x}]_n,$$

where each $D^3$ is an independently selected divalent linking group, $Z^1$ is as defined and described above, $R^7$ is Y or H, and each Y, R, subscript a, X, superscript y, superscript x, and subscript n is as defined above and described below.

As introduced above, each $D^3$ of the amino substituted hydrocarbon divalent linking group is independently selected. Typically, each $D^3$ comprises an independently selected alkylene group, such as any of those described above with respect to divalent linking group $D^1$. For example, in some embodiments, each $D^3$ is independently selected from alkylene groups having from 1 to 8 carbon atoms, such as from 2 to 8, alternatively from 2 to 6, alternatively from 2 to 4 carbon atoms. In certain embodiments, each $D^3$ is propylene (i.e., —$(CH_2)_3$—). However, it is to be appreciated that one or both $D^3$ may be, or comprise, another divalent linking group (i.e., aside from the alkylene groups described above). Moreover, each $D^3$ may be substituted or unsubstituted, linear or branched, and various combinations thereof.

As also introduced above, $R^7$ of the amino substituted hydrocarbon is H or quaternary ammonium moiety Y (i.e., of formula -D-$NR^1{}_3$+, as set forth above). For example, in particular embodiments, $R^7$H, such that the siloxane cationic surfactant (A) may be represented by the following formula:

$$[Z^1\text{-}D^3\text{-}NH\text{-}D^3\text{-}N(Y)_a(R)_{2-a}]^{+y}[X^{-x}]_n,$$

where each $D^3$ and $Z^1$ is as defined and described above and each Y, R, subscript a, X, superscript y, superscript x, and subscript n is as defined above and described below. In such embodiments, as will be appreciated from the further description below, superscript y is 1 or 2, controlled by subscript a. More particularly, the number of quaternary ammonium moieties Y will be controlled by subscript a as 1 or 2, providing a total cationic charge of +1 or +2, respectively. Accordingly, in such embodiments, superscript x will also be 1 or 2, such that the siloxane cationic surfactant (A) will be charge balanced.

In certain embodiments, $R^7$ of the amino substituted hydrocarbon is the quaternary ammonium moiety Y, such that the siloxane cationic surfactant (A) may be represented by the following formula:

$$[Z^1\text{-}D^3\text{-}NY\text{-}D^3\text{-}N(Y)_a(R)_{2-a}]^{+y}[X^{-x}]_n,$$

where each $D^3$ and $Z^1$ is as defined and described above and each Y, R, subscript a, X, superscript y, superscript x, and subscript n is as defined above and described below. In such embodiments, y=a+1, such that superscript y is 2 or 3. More particularly, the number of quaternary ammonium moieties will include the Y of $R^7$ as well as the 1 or 2 quaternary ammonium moiety Y controlled by subscript a, providing a total cationic charge of +2 or +3, respectively. Accordingly, in such embodiments, superscript x will be 1, 2, or 3, such that the siloxane cationic surfactant (A) will be charge balanced.

In some embodiments, $R^7$ is Y and the siloxane moiety $Z^1$ is the branched siloxane moiety described above, such that the siloxane cationic surfactant (A) may be represented by the following formula:

$$[(R^3)_3Si\text{-}D^3\text{-}N(\text{-}D\text{-}NR^1{}_3{}^+)\text{-}D^3\text{-}N(\text{-}D\text{-}NR^1{}_3{}^+)_a(R)_{2-a}]^{+y}[X^{-x}]_n,$$

where each $D^3$ and $R^3$ is as defined and described above, and each D, R, $R^1$, subscript a, X, superscript y, superscript x, and subscript n is as defined above and described below.

Subscript a is 1 or 2. As will be appreciated by those of skill in the art, subscript a indicates whether the quaternary ammonium-substituted amino moiety of the siloxane cationic surfactant (A) represented by subformula $—N(Y)_a(R)_{2-a}$ has one or two of quaternary ammonium groups Y (i.e., the group of subformula $(-D-NR^1{}_3{}^+)$. Likewise, as each such quaternary ammonium groups Y, subscript a also indicates the number of counter anions (i.e., number of anions X, as described below) required to balance out the cationic charge from the quaternary ammonium groups Y indicated by moieties a. For example, in some embodiments, subscript a is 1, and the siloxane cationic surfactant (A) has the following formula:

$$[Z^1\text{-}D^1\text{-}N(R)\text{-}D\text{-}NR^1{}_3]^{+y}[X^{-x}]_n,$$

where $Z^1$ and $D^1$ are as defined and described above, and each D, R, $R^1$, X, superscript y, superscript x, and subscript n is as defined above and described below.

It is to be appreciated that, while subscript a is 1 or 2 in each cationic molecule of the siloxane cationic surfactant (A), the siloxane cationic surfactant (A) may comprise a mixture of cationic molecules that correspond to formula (I) but are different from one another (e.g. with respect to subscript a). As such, while subscript a is 1 or 2, a mixture comprising the siloxane cationic surfactant (A) may have an average value of a of from 1 to 2, such as an average value of 1.5 (e.g. from a 50:50 mixture of cationic molecules of the siloxane cationic surfactant (A) where a=1 and molecules of the siloxane cationic surfactant (A) where a=2.

Each R independently represents H or an unsubstituted hydrocarbyl group having from 1 to 4 carbon atoms, when present (e.g. when subscript a is 1). In some embodiments, R is H. In other embodiments, R an alkyl group having from 1 to 4 carbon atoms, such as from 1 to 3, alternatively from 1 to 2 carbon atom(s). For example, R may be a methyl group, an ethyl group, a propyl group (e.g. an n-propyl or iso-propyl group), or a butyl group (e.g. an n-butyl, sec-butyl, iso-butyl, or tert-butyl group). In certain embodiments, each R is methyl.

Each $R^1$ represents an independently selected unsubstituted hydrocarbyl group having from 1 to 4 carbon atoms. For example, in certain embodiments, each $R^1$ is independently selected from alkyl groups having from 1 to 4 carbon atoms, such as from 1 to 3, alternatively from 1 to 2 carbon atom(s). In such embodiments, each $R^1$ is typically selected from methyl groups, ethyl groups, propyl groups (e.g. n-propyl and iso-propyl groups), and butyl group (e.g. n-butyl, sec-butyl, iso-butyl, and tert-butyl groups). While independently selected, in certain embodiments each $R^1$ is the same as each other $R^1$ in the cationic surfactant. For example, in certain embodiments, each $R^1$ is methyl or ethyl. In specific embodiments, each $R^1$ is methyl.

Each D represents an independently selected divalent linking group ("linking group D"). Typically, linking group D is selected from substituted and unsubstituted divalent hydrocarbon groups. Examples of such hydrocarbon groups include divalent forms of the hydrocarbyl and hydrocarbon groups described above, such as any of those set forth above with respect to $R^x$, $D^1$, and $D^3$. As such, it will be appreciated that suitable hydrocarbon groups for use in or as linking group D may be linear or branched, and may be the same as or different from any other divalent linking group.

In certain embodiments, linking group D comprises an alkylene group, such as one of those described above with respect to divalent linking group $D^1$. For example, in certain embodiments, linking group D comprises an alkylene group having from 1 to 8 carbon atoms, such as from 1 to 6, alternatively from 2 to 6, alternatively from 2 to 4 carbon atoms. In some such embodiments, the alkylene group of linking group D is unsubstituted. Examples of such alkylene groups include methylene groups, ethylene groups, propylene groups, butylene groups, etc.

In certain embodiments, linking group D comprises, alternatively is, a substituted hydrocarbon group, such as a substituted alkylene group. In such embodiments, for example, linking group D typically comprises a carbon backbone having at least 2 carbon atoms, and at least one heteroatom (e.g. O) in the backbone or bonded to one of the carbon atoms thereof (e.g. as a pendant substituent). For example, in some embodiments, linking group D comprises a hydroxyl-substituted hydrocarbon having formula $-D'-CH(—(CH_2)_e—OH)-D'-$, where each D' is independently a covalent bond or a divalent linking group, and subscript e is 0 or 1. In such embodiments, at least one D' typically comprises an independently selected alkylene group, such as any of those described above. For example, in some embodiments, each D' is independently selected from alkylene groups having from 1 to 8 carbon atoms, such as from 1 to 6, alternatively from 1 to 4, alternatively from 1 to 2 carbon atoms. In certain embodiments, each D' is methylene (i.e., $—CH_2—$). However, it is to be appreciated that one or both D' may be, or comprise, another divalent linking group (i.e., aside from the alkylene groups described above).

In some embodiments, each linking group D is an independently selected hydroxypropylene group (i.e., where each D' is an independently selected from the covalent bond and methylene, with the provisos that at least one D' is the covalent bond when subscript e is 1, and each D' is methylene when subscript e is 0). Accordingly, in some such embodiments, each linking group D is independently of one of the following formulas:

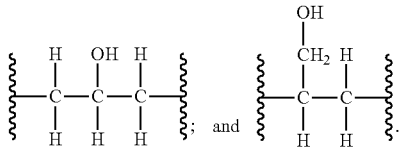

In some embodiments, siloxane moiety $Z^1$ is the branched siloxane moiety, divalent linking group D is the amino substituted hydrocarbon where each $D^3$ is propylene and $R^7$ is H, subscript a is 1, R is H, each linking group D is a (2-hydroxy)propylene group, each $R^1$ is methyl, and X is a monoanion, such that the siloxane cationic surfactant (A) has the following formula:

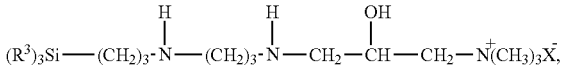

where each $R^3$ is as defined and described above, and X is as defined above and described below. In other embodiments, the siloxane cationic surfactant (A) is configured the same as described immediately above, but with subscript a=2, such that the siloxane cationic surfactant (A) has the following formula:

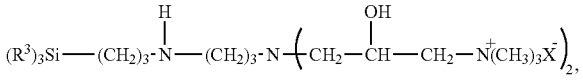

where each $R^3$ is as defined and described above, and each X is as defined above and described below. In other embodiments, the siloxane cationic surfactant (A) is configured the same as described immediately above, but with $R^7$ being the quaternary ammonium moiety Y, such that the siloxane cationic surfactant (A) has the following formula:

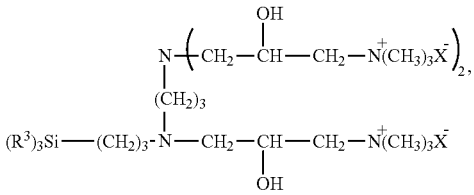

where each $R^3$ is as defined and described above, and each X is as defined above and described below. In yet other embodiments, the siloxane cationic surfactant (A) is configured the same as described immediately above, but with subscript a=1 and R being H, such that the siloxane cationic surfactant (A) has the following formula:

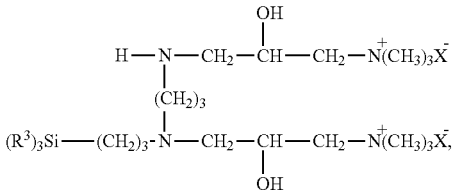

where each $R^3$ is as defined and described above, and each X is as defined above and described below.

Each X is an anion having a charge represented by superscript x. Accordingly, as will be understood by those of skill in the art, X is not particularly limited and may be any anion suitable for ion-pairing/charge-balancing one or more cationic quaternary ammonium moieties Y. As such, each X may be an independently selected monoanion or polyanion (e.g. dianion, etc.), such that one X may be sufficient to counterbalance two or more cationic quaternary ammonium moieties Y. As such, the number of anions X (i.e., subscript n) will be readily selected based on the number of cationic quaternary ammonium moieties Y and the charge of X selected (i.e., superscript x).

Examples of suitable anions include organic anions, inorganic anions, and combinations thereof. Typically, each anion X is independently selected from monoanions that are unreactive the other moieties of the cationic surfactant. Examples of such anions include conjugate bases of medium and strong acids, such as halide ions (e.g. chloride, bromide, iodide, fluoride), sulfates (e.g. alkyl sulfates, etc.), sulfonates (e.g. triflates, benzyl or other aryl sulfonates, etc.), and the like, as well as derivatives, modifications, and combinations thereof. Other anions may also be utilized, such as phosphates, nitrates, organic anions such as carboxylates (e.g. acetates), and the like, as well as derivatives, modifications, and combinations thereof. It is to be appreciated that derivatives of such anions include polyanionic compounds comprising two or more functional groups for which the above examples are named. For example, mono and/or polyanions of polycarboxylates (e.g. citric acid, etc.) are encompassed by the anions above. Other examples of anions include tosylate anions, bis(trifluoromethanesulfonyl)imide anions, bis(fluorosulfonyl)imide anions, hexafluorophosphate anions, tetrafluoroborate anions, and the like, as well as derivatives, modifications, and combinations thereof.

In certain embodiments, each anion X is an inorganic anion having one to three valences. Examples of such anions include monoanions such as chlorine, bromine, iodine, aryl sulfonates having six to 18 carbon atoms, nitrates, nitrites, and borate anions, dianions such as sulfate and sulfite, and trianions such as phosphate. In certain embodiments, each X is a halide anion. In some such embodiments, each X is chloride (i.e., $Cl^-$).

The siloxane cationic surfactant (A) may comprise a combination or two or more different siloxane cationic surfactants represented by general formula (I) above that differ in at least one property such as structure, molecular weight, degree of branching, silicon and/or carbon content, number of cationic quaternary ammonium groups Y (e.g. when subscript a represents an average value), etc.

The siloxane cationic surfactant (A) may be utilized in any amount in the composition, depending on the form of the composition prepared, a desired use thereof, other components present therein, etc. For example, one of skill in the art will appreciate that, when the composition is formulated as a concentrate, the siloxane cationic surfactant (A) will be present in higher relative amounts as compared to non-concentrated forms (e.g. aqueous film-forming foam compositions). As such, the siloxane cationic surfactant (A) may be present in the composition in any amount, such as an amount of from 0.001 to 60 wt. %, based on the total weight of the composition (i.e., wt./wt.). Typically, the composition comprises the siloxane cationic surfactant (A) in an amount sufficient to provide an end-use composition (i.e., any fully formulated composition comprising the foam stabilizing composition ready for a use) with from 0.01 to 1 wt. % of the siloxane cationic surfactant (A), based on the total weight of the end-use composition (i.e., an active amount of component (A) of from 0.01 to 1 wt. %). For example, in certain embodiments, component (A) is utilized in an active amount of from 0.05 to 1 wt. %, such as from 0.1 to 0.9, alternatively from 0.1 to 0.7, alternatively from 0.1 to 0.5, alternatively from 0.1 to 0.4, alternatively from 0.15 to 0.4, alternatively from 0.2 to 0.4 wt. %, based on the total weight of the composition, or an end-use composition comprising the same.

As introduced above, component (B) of the composition is an organic cationic surfactant, i.e., a complex comprising a cationic quaternary organoammonium compound charge-balanced with a counter ion. In particular, the organic cationic surfactant (B) comprises a hydrocarbon moiety and one or more quaternary ammonium moieties, and conforms to general formula (II):

$$[Z^2\text{-}D^2\text{-}N(Y)_b(R)_{2-b}]^{+y}[X^{-x}]_n \quad \text{(II)},$$

wherein $Z^2$ is an unsubstituted hydrocarbyl group; $D^2$ is a covalent bond or a divalent linking group; subscript b is 1 or 2; and each R, Y, superscript y, X, subscript n, and superscript x is independently selected and as defined above.

With regard to the organic cationic surfactant (B) and formula (II), each R, Y, superscript y, X, subscript n, and superscript x is independently selected and as defined above with respect to the siloxane cationic surfactant (A). As such, while specific selections are exemplified below with regard to these variables in formula (II) representing the organic cationic surfactant (B), it will be appreciated that such selections are not limiting, but rather that all description of R, Y, superscript y, X, subscript n, and superscript x, as well as variables thereof (e.g. divalent linking group D of quaternary ammonium moieties Y, groups D and subscripts e of divalent linking groups D, etc.).

$Z^2$ is an unsubstituted hydrocarbyl group, and is otherwise not particularly limited. Examples of suitable such hydrocarbyl moieties include the unsubstituted monovalent hydrocarbon moieties described above with respect to $R^x$. As such, it will be appreciated that the hydrocarbyl moiety $Z^2$ may comprise, alternatively may be, linear, branched, cyclic, or combinations thereof. Likewise, the hydrocarbyl group $Z^2$ may comprise aliphatic unsaturation, including ethylenic and/or acetylenic unsaturation (i.e., C—C double and/or triple bonds, otherwise known as alkenes and alkynes, respectively). The hydrocarbyl group $Z^2$ may comprise but one such unsaturated group or, alternatively, may comprise more than one unsaturated group, which may be nonconjugated, or conjugated (e.g. when the hydrocarbyl moiety $Z^2$ comprises a diene, a ene-yne, diyne, etc.) and/or aromatic (e.g. when the hydrocarbyl moiety $Z^2$ comprises a phenyl group, benzyl group, etc.).

In some embodiments, the hydrocarbyl moiety $Z^2$ is an unsubstituted hydrocarbyl moiety having from 5 to 20 carbon atoms. In certain such embodiments, the hydrocarbyl moiety $Z^2$ comprises, alternatively is, an alkyl group. Suitable alkyl groups include saturated alkyl groups, which may be linear, branched, cyclic (e.g. monocyclic or polycyclic), or combinations thereof. Examples of such alkyl groups include those having the general formula $C_fH_{2f-2g+1}$, where subscript f is from 5 to 20 (i.e., the number of carbon atoms present in the alkyl group), subscript g is the number of independent rings/cyclic loops, and at least one carbon atom designated by subscript f is bonded to group $D^2$ in general formula (II) above. Examples of linear and branched isomers of such alkyl groups (i.e., where the alkyl group is free from cyclic groups such that subscript f=0), include those having the general formula $C_fH_{2f+1}$, where subscript f is as defined above and at least one carbon atom designated by subscript f is bonded to group $D^2$ in general formula (II) above. Examples of monocyclic alkyl groups include those having the general formula $C_fH_{2f-1}$, where subscript f is as defined above and at least one carbon atom designated by subscript f is bonded to group $D^2$ in general formula (II) above.

Specific examples of such alkyl groups include pentyl groups, hexyl groups, heptyl groups, octyl groups, nonyl groups, decyl groups, undecyl groups dodecyl groups, tridecyl groups, tetradecyl groups, pentadecyl groups, hexadecyl groups, heptadecyl groups, octadecyl groups, nonadecyl groups, and eicosyl groups, including linear, branched, and/or cyclic isomers thereof. For example, pentyl groups encompass n-pentyl (i.e., a linear isomer) and cyclopentyl (i.e., a cyclic isomer), as well as branched isomers such as isopentyl (i.e., 3-methylbutyl), neopentyl (i.e., 2,2-dimethylpropy), tert-pentyl (i.e., 2-methylbutan-2-yl), sec-pentyl (i.e., pentan-2-yl), sec-isopentyl (i.e., 3-methylbutan-2-yl) etc.), 3-pentyl (i.e., pentan-3-yl), and active pentyl (i.e., 2-methylbutyl).

In certain embodiments, the hydrocarbyl moiety $Z^2$ comprises, alternatively is, an unsubstituted linear alkyl group of formula —$(CH_2)_{f-1}CH_3$, where subscript f is from 5 to 20 as described above. In some such embodiments, the hydrocarbyl moiety $Z^2$ is such an unsubstituted linear alkyl group, where subscript f is from 7 to 19, such that the hydrocarbyl moiety $Z^2$ is an unsubstituted linear alkyl group having from 6 to 18 carbon atoms. In certain such embodiments, subscript b is 7, 9, 11, or 13, such that the hydrocarbyl moiety $Z^2$ is an unsubstituted linear alkyl group having 6, 8, 10, or 12 carbon atoms, respectively.

Subscript b is 1 or 2. As will be appreciated by those of skill in the art in view of the description relating to subscript a of the siloxane cationic surfactant (A), subscript b indicates whether the quaternary ammonium-substituted amino moiety of the organic cationic surfactant (B) represented by subformula —$N(Y)_b(R)_{2-b}$ has one or two of quaternary ammonium groups Y (i.e., the group of subformula (-D-$NR^1{}_3$+). Likewise, as each such quaternary ammonium groups Y, subscript b also indicates the number of counter anions (i.e., number of anions X, as described below) required to balance out the cationic charge from the quaternary ammonium groups Y indicated by moieties b.

It is to be appreciated that, while subscript b is 1 or 2 in each cationic molecule of the organic cationic surfactant (B), the organic cationic surfactant (B) may comprise a mixture of cationic molecules that correspond to formula (II) but are different from one another (e.g. with respect to subscript b). As such, while subscript b is 1 or 2, a mixture comprising the organic cationic surfactant (B) may have an average value of b of from 1 to 2, such as an average value of 1.5 (e.g. from a 50:50 mixture of cationic molecules of the organic cationic surfactant (B) where b=1 and molecules of the organic cationic surfactant (B) where b=2.

With further regard to the organic cationic surfactant (B) and formula (II), as introduced above, $D^2$ represents a covalent bond or a divalent linking group. For clarity and ease of reference, with respect to specific embodiments below, $D^2$ may be referred to more particularly as the "covalent bond $D^2$" or "divalent linking group $D^2$", e.g. when $D^2$ is the covalent bond or the divalent linking group, respectively. Both selections are described and illustrated in certain embodiments below.

In certain embodiments, $D^2$ is the covalent bond (i.e., the organic cationic surfactant (B) comprises the covalent bond $D^2$), such that hydrocarbyl moiety $Z^2$ is bonded directly to the amino N atom. In these embodiments, the organic cationic surfactant (B) may be represented by the following formula:

$$[Z^2—N(Y)_b(R)_{2-b}]^{+y}[X^{-x}]_n,$$

where each $Z^2$, Y, R, X, subscript b, superscript y, superscript x, and subscript n are as defined and described above. In some such embodiments, the hydrocarbyl moiety $Z^2$ is an alkyl group bonded directly to the amino N atom of the organic cationic surfactant (B), such that the organic cationic surfactant (B) has the following formula:

$$[(C_fH_{2f+1})—N(Y)_b(R)_{2-b}]^{+y}[X^{-x}]_n,$$

where subscript b, subscript f, Y, R, X, superscript y, superscript x, and subscript n are as defined and described above. In some such embodiments, subscript f is from 6 to 18, such as from 6 to 14, alternatively from 6 to 12.

In certain embodiments, $D^2$ is the divalent linking group bond (i.e., the organic cationic surfactant (B) comprises the divalent linking group $D^2$). The divalent linking group $D^1$ is not particularly limited, and is generally selected from the same groups described above with respect to divalent linking group $D^1$. Accordingly, divalent linking group $D^2$ is typically selected from divalent hydrocarbon groups. Examples of such hydrocarbon groups include divalent forms of the hydrocarbyl and hydrocarbon groups described above, such as any of those set forth above with respect to $R^x$. As such, it will be appreciated that suitable hydrocarbon groups for the divalent linking group $D^2$ may be substituted or unsubstituted, linear, branched, and/or cyclic, and the same or different from any other linking group in the organic cationic surfactant (B) and/or the siloxane cationic surfactant (A).

In some embodiments, divalent linking group $D^2$ comprises, alternatively is a linear or branched alkyl and/or alkylene group. In certain embodiments, divalent linking group $D^2$ comprises, alternatively is, a $C_1$-$C_{18}$ hydrocarbon moiety, such as the linear hydrocarbon moiety having the formula $—(CH_2)_d—$, defined above with respect to $D^1$ (i.e., where subscript d is from 1 to 18). In some such embodiments, subscript d is from 1 to 16, such as from 1 to 12, alternatively from 1 to 10, alternatively from 1 to 8, alternatively from 1 to 6, alternatively from 2 to 6, alternatively from 2 to 4. In particular embodiments, subscript d is 3, such that divalent linking group $D^2$ comprises a propylene (i.e., a chain of 3 carbon atoms). It will also be appreciated that each alkyl and/or alkylene group suitable for $D^2$ may independently be unsubstituted and unbranched, or substituted and/or branched. In certain embodiments, divalent linking group $D^2$ comprises, alternatively is, an unsubstituted alkylene group. In other embodiments, divalent linking group $D^2$ comprises, alternatively is, a substituted hydrocarbon group, such as a substituted alkylene group. In such embodiments, for example, divalent linking group $D^2$ typically comprises a carbon backbone having at least 2 carbon atoms and at least one heteroatom (e.g. O, N, S, etc.), such that the backbone comprises an ether moiety, amine moiety, etc.

In particular embodiments, divalent linking group $D^2$ comprises, alternatively is, an amino substituted hydrocarbon group (i.e., a hydrocarbon comprising a nitrogen-substituted carbon chain/backbone). For example, in some such embodiments, the divalent linking group $D^2$ is an amino substituted hydrocarbon having formula $-D^4-N(R^8)-D^4-$, such that the organic cationic surfactant (B) may be represented by the following formula:

$$[Z^2\text{-}D^4\text{-}N(R^8)\text{-}D^4\text{-}N(Y)_b(R)_{2-b}]^{+y}[X^{-x}]_n,$$

where each $D^4$ is an independently selected divalent linking group, $R^8$ is Y or H, and each $Z^2$, Y, R, subscript b, X, superscript y, superscript x, and subscript n is as defined and described above.

As introduced above, each $D^4$ of the amino substituted hydrocarbon divalent linking group is independently selected. Typically, each $D^4$ comprises an independently selected alkylene group, such as any of those described above with respect to divalent linking group $D^3$ of the siloxane cationic surfactant (A). For example, in some embodiments, each $D^4$ is independently selected from alkylene groups having from 1 to 8 carbon atoms, such as from 2 to 8, alternatively from 2 to 6, alternatively from 2 to 4 carbon atoms. In certain embodiments, each $D^4$ is propylene (i.e., $—(CH_2)_3—$). However, it is to be appreciated that one or both $D^4$ may be, or comprise, another divalent linking group (i.e., aside from the alkylene groups described above). Moreover, each $D^4$ may be substituted or unsubstituted, linear or branched, and various combinations thereof.

As also introduced above, $R^8$ of the amino substituted hydrocarbon is H or quaternary ammonium moiety Y (i.e., of formula $-D-NR^1{}_3+$, as set forth above). For example, in particular embodiments, $R^8H$, such that the organic cationic surfactant (B) may be represented by the following formula:

$$[Z^2\text{-}D^4\text{-}NH\text{-}D^4\text{-}N(Y)_b(R)_{2-b}]^{+y}[X^{-x}]_n,$$

where each $Z^2$, $D^4$, Y, R, subscript b, X, superscript y, superscript x, and subscript n is as defined and described above. In such embodiments, as will be appreciated from the further description below, superscript y is 1 or 2, controlled by subscript b. More particularly, the number of quaternary ammonium moieties Y will be controlled by subscript b as 1 or 2, providing a total cationic charge of +1 or +2, respectively. Accordingly, in such embodiments, superscript x will also be 1 or 2, such that the organic cationic surfactant (B) will be charge balanced.

In certain embodiments, $R^8$ is Y, such that the organic cationic surfactant (B) may be represented by the following formula:

$$[Z^2\text{-}D^4\text{-}NY\text{-}D^4\text{-}N(Y)_b(R)_{2-b}]^{+y}[X^{-x}]_n,$$

where each $Z^2$, $D^4$, Y, R, subscript b, X, superscript y, superscript x, and subscript n is as defined and described above. In such embodiments, y=b+1, such that superscript y is 2 or 3. More particularly, the number of quaternary ammonium moieties will include the Y of $R^8$ as well as the 1 or 2 quaternary ammonium moiety Y controlled by subscript b, providing a total cationic charge of +2 or +3, respectively. Accordingly, in such embodiments, superscript x will be 1, 2, or 3, such that the organic cationic surfactant (B) will be charge balanced. For example, in some such embodiments, subscript b is 1 and X is monoanionic, such that the organic cationic surfactant (B) has the following formula:

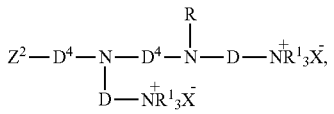

where each $Z^2$, $D^4$, R, $R^1$, and X is as defined and described above. In other such embodiments, the organic cationic surfactant (B) is configured as described immediately above, but with b=2, such that the organic cationic surfactant (B) has the following formula:

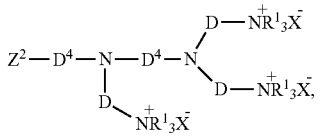

where each $Z^2$, $D^4$, R, $R^1$, and X is as defined and described above.

In certain embodiments, $D^2$ is the covalent bond, $Z^2$ is the linear alkyl group, subscript b is 1, R is H, each linking group D is a (2-hydroxy)propylene group, each $R^1$ is methyl, and X is a monoanion, such that the organic cationic surfactant (B) has the following formula:

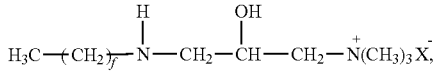

where subscript f is from 5 to 17 (e.g. from 5 to 11, alternatively from 5 to 9), and X is as defined and described above. In other embodiments, the organic cationic surfactant (B) is configured the same as described immediately above, but with subscript b=2, such that the organic cationic surfactant (B) has the following formula:

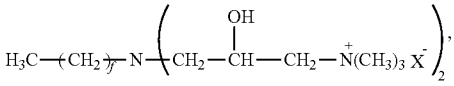

where each X is as defined above and described below.

In certain embodiments, $Z^2$ is a linear alkyl group having from 3 to 13 carbon atoms, $D^2$ the divalent linking group and the divalent linking group $D^2$ is the amino substituted hydrocarbon where each $D^4$ is propylene and $R^8$ is H, subscript b is 1, R is H, each linking group D is a (2-hydroxy)propylene group, each $R^1$ is methyl, and X is a monoanion, such that the organic cationic surfactant (B) has the following formula:

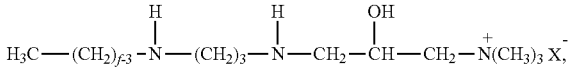

where subscript f and X are as defined and described above. In other embodiments, the organic cationic surfactant (B) is configured the same as described immediately above, but with subscript b=2, such that the organic cationic surfactant (B) has the following formula:

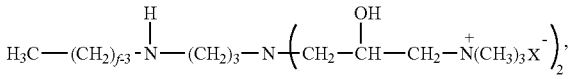

where subscript f and each X are as defined and described above. In other embodiments, the organic cationic surfactant (B) is configured the same as described immediately above, but with $R^8$ being the quaternary ammonium moiety Y, such that the organic cationic surfactant (B) has the following formula:

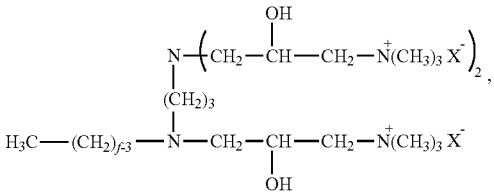

where subscript f and each X are as defined and described above. In yet other embodiments, the organic cationic surfactant (B) is configured the same as described immediately above, but with subscript b=1 and R being H, such that the organic cationic surfactant (B) has the following formula:

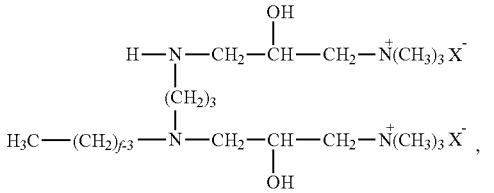

where subscript f and each X are as defined and described above.

In certain embodiments, each anion X of the organic cationic surfactant (B) is an inorganic anion having one to three valences. Examples of such anions include monoanions such as chlorine, bromine, iodine, aryl sulfonates having six to 18 carbon atoms, nitrates, nitrites, and borate anions, dianions such as sulfate and sulfite, and trianions such as phosphate. In certain embodiments, each X is a halide anion. In some such embodiments, each X is chloride (i.e., $Cl^-$).

The organic cationic surfactant (B) may comprise a combination or two or more different siloxane cationic surfactants represented by general formula (II) above that differ in at least one property such as structure, molecular weight, degree of branching, silicon and/or carbon content, number of cationic quaternary ammonium groups Y (e.g. when subscript b represents an average value), etc.

The organic cationic surfactant (B) may be utilized in any amount in the composition, depending on the form of the composition prepared, a desired use thereof, other components present therein, etc. For example, one of skill in the art will appreciate that, when the composition is formulated as a concentrate, the organic cationic surfactant (B) will be present in higher relative amounts as compared to non-concentrated forms (e.g. aqueous film-forming foam compositions). As such, the organic cationic surfactant (B) may be present in the composition in any amount, such as an amount of from 0.001 to 60 wt. %, based on the total weight of the composition (i.e., wt./wt.). Typically, the composition comprises the organic cationic surfactant (B) in an amount sufficient to provide an end-use composition (i.e., any fully formulated composition comprising the foam stabilizing composition ready for a use) with from 0.01 to 1 wt. % of the organic cationic surfactant (B), based on the total weight of the end-use composition (i.e., an active amount of organic cationic surfactant (B) of from 0.01 to 1 wt. %). For example, in certain embodiments, component (B) is utilized in an active amount of from 0.05 to 1 wt. %, such as from 0.1 to 1, alternatively from 0.1 to 0.9, alternatively from 0.1 to 0.7, alternatively from 0.2 to 0.7, alternatively from 0.2 to 0.5 wt. %, based on the total weight of the composition, or an end-use composition comprising the same.

It is to be appreciated that each of the siloxane cationic surfactant (A) and the organic cationic surfactant (B) is independently selected, and thus each variable in formulas (I) and (II), even where representing the same group/moiety and/or having the same definition, is independently selected. However, in certain embodiments, the siloxane cationic surfactant (A) and the organic cationic surfactant (B) are configured in a similar manner with respect to one or more variables in in formulas (I) and (II). For example, in certain embodiments, each $R^1$ of the siloxane cationic surfactant (A) and the organic cationic surfactant (B) is methyl. In these or other embodiments, each D of the siloxane cationic surfactant (A) and the organic cationic surfactant (B) is independently a hydroxypropylene group of one of the following formulas:

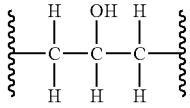

; and

-continued

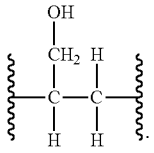

In these or other embodiments, each anion X of the siloxane cationic surfactant (A) and the organic cationic surfactant (B) is the same. For example, in some such embodiments, each X of the siloxane cationic surfactant (A) and the organic cationic surfactant (B) is a halide anion, alternatively is chloride ($Cl^-$).

In certain embodiments, the composition comprises a siloxane cationic surfactant (A) having one of the following formulas (A-i)-(A-vii):

(A-i)

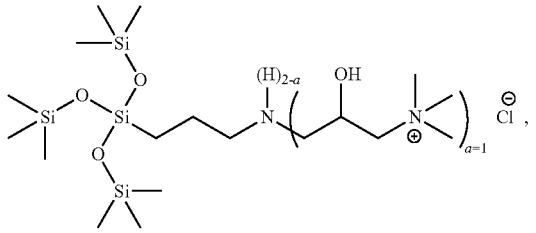

(A-ii)

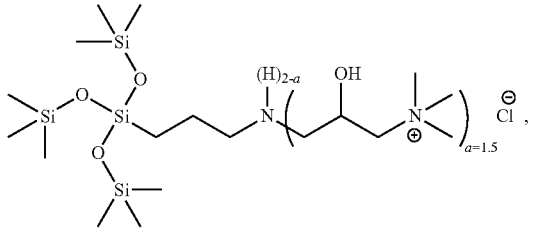

(A-iii)

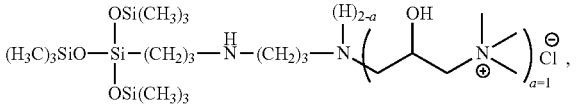

(A-iv)

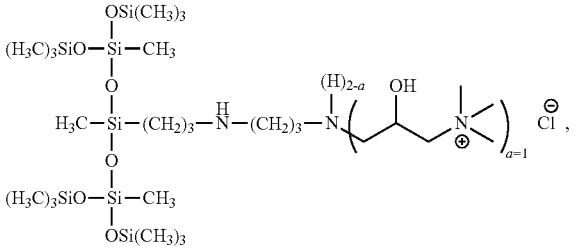

-continued (A-v)

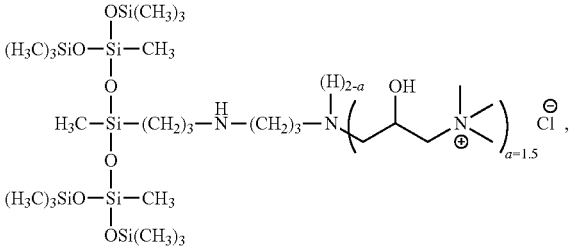

(A-vi)

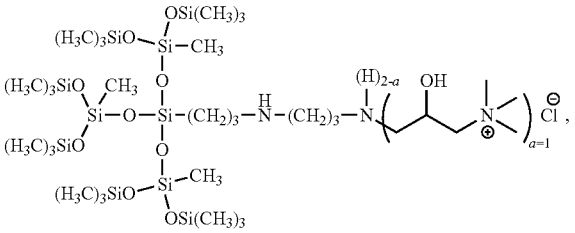

(A-vii)

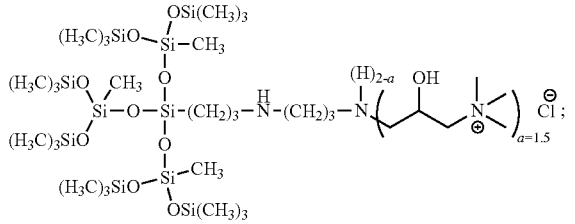

and an organic cationic surfactant (B) having one of the following formulas (B-i)-(B-iii):

(B-i)

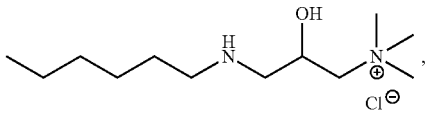

(B-ii)

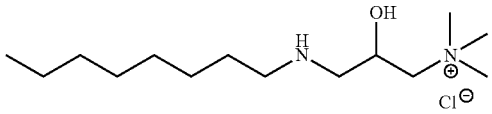

, and (B-iii)

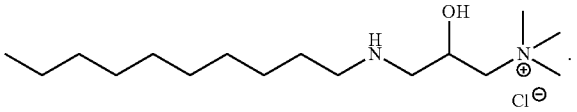

The relative amounts of the siloxane cationic surfactant (A) and the organic cationic surfactant (B) utilized in the composition vary, e.g. based upon the particular siloxane cationic surfactant (A) selected, the particular organic cationic surfactant (B) selected, whether another component is utilized in the composition, etc.

Typically, the siloxane cationic surfactant (A) and the organic cationic surfactant (B) are utilized in a ratio of from 10:1 to 1:10, such as from 8:1 to 1:8, alternatively from 6:1 to 1:6, alternatively from 4:1 to 1:4, alternatively from 2:1 to 1:2, alternatively 1:1 (A):(B). For example, in certain embodiments, the composition may comprise an excess of component (B) in relation to component (A), such that the siloxane cationic surfactant (A) and the organic cationic surfactant (B) are utilized in a weight ratio (i.e., wt./wt.) of from less than 1:1 (A):(B), such as from 1:1.1 to 1:10, alternatively from 1:1.5 to 1:10, alternatively from 1:2 to 1:10, alternatively from 1:3 to 1:10, alternatively from 1:4 to 1:10, alternatively from 1:5 to 1:10 (A):(B). In other embodiments, the composition may comprise an excess of component (A) in relation to component (B), such that the siloxane cationic surfactant (A) and the organic cationic surfactant (B) are utilized in a weight ratio (i.e., wt./wt.) of from greater than 1:1 (A):(B), such as from 1.1:1 to 10:1, alternatively from 1.5:1 to 10:1, alternatively from 2:1 to 10:1, alternatively from 2:1 to 8:1, alternatively from 2:1 to 6:1, alternatively from 2:1 to 5:1 (A):(B). It will be appreciated, however, that ratios outside of the specific ranges above may also be utilized. For example, in certain embodiments, one of the siloxane cationic surfactant (A) and organic cationic surfactant (B) is utilized in a gross excess of the other (e.g. in an amount of ≥5, alternatively ≥10, alternatively ≥15, alternatively ≥20, times amount of the other).

The composition may comprise a carrier vehicle (e.g. a solvent, diluent, dispersant, etc.). In such embodiments, the carrier vehicle will be selected based on the particular components (A) and (B) selected, as well as any other components utilized in the composition and/or to be combined with the composition (i.e., in an end-use composition). Carrier vehicles are known in the art, and generally comprise solvents, fluids, oils, and the like, as well as combinations thereof.

Examples of solvents include aqueous solvents, organic solvents, and combinations thereof. Examples of aqueous solvents include water and polar and/or charged (i.e., ionic) solvents compatible with water. Examples of organic solvents include those comprising an alcohol, such as methanol, ethanol, isopropanol, butanol, and n-propanol; a ketone, such as acetone, methylethyl ketone, and methyl isobutyl ketone; an aromatic hydrocarbon, such as benzene, toluene, and xylene; an aliphatic hydrocarbon, such as heptane, hexane, and octane; a glycol ether, such as propylene glycol methyl ether, dipropylene glycol methyl ether, propylene glycol n-butyl ether, propylene glycol n-propyl ether, and ethylene glycol n-butyl ether; a halogenated hydrocarbon, such as dichloromethane, 1,1,1-trichloroethane, and chloroform; dimethyl sulfoxide; dimethyl formamide, acetonitrile; tetrahydrofuran; white spirits; mineral spirits; naphtha; n-methylpyrrolidone; and the like, as well as derivatives, modifications, and combination thereof. Specific examples of such polar organic solvents generally compatible with water include methanol, ethanol, 1-propanol, 2-propanol, 2-methyl-2-propanol, 2-butanone, tetrahydrofuran, acetone, and combinations thereof.

Examples of fluids include organic fluids, silicone fluids, and combinations thereof. Organic fluids typically comprise an organic oil including a volatile and/or semi-volatile hydrocarbon, ester, and/or ether. General examples of such organic fluids include volatile hydrocarbon oils, such as $C_6$-$C_{16}$ alkanes, $C_8$-$C_{16}$ isoalkanes (e.g. isodecane, isododecane, isohexadecane, etc.), $C_8$-$C_{16}$ branched esters (e.g. isohexyl neopentanoate, isodecyl neopentanoate, etc.), and the like, as well as derivatives, modifications, and combinations thereof. Additional examples of organic fluids include aromatic hydrocarbons, aliphatic hydrocarbons, alcohols having more than 3 carbon atoms, aldehydes, ketones, amines, esters, ethers, glycols, glycol ethers, alkyl halides, aromatic halides, and combinations thereof. Hydrocarbons include isododecane, isohexadecane, Isopar L ($C_{11}$-$C_{13}$), Isopar H ($C_{11}$-$C_{12}$), hydrogenated polydecene. Ethers and esters include isodecyl neopentanoate, neopentylglycol heptanoate, glycol distearate, dicaprylyl carbonate, diethylhexyl carbonate, propylene glycol n-butyl ether, ethyl-3 ethoxypropionate, propylene glycol methyl ether acetate, tridecyl neopentanoate, propylene glycol methylether acetate (PGMEA), propylene glycol methylether (PGME), octyldodecyl neopentanoate, diisobutyl adipate, diisopropyl adipate, propylene glycol dicaprylate/dicaprate, octyl ether, octyl palmitate, and combinations thereof. Silicone fluids typically comprise a low viscosity and/or volatile siloxane. Examples of such silicone fluids include those including a low viscosity organopolysiloxane, a volatile methyl siloxane, a volatile ethyl siloxane, a volatile methyl ethyl siloxane, or the like, or combinations thereof. Typically, silicone fluids have a viscosity at 25° C. in the range of 1 to 1,000 $mm^2$/sec. Specific examples of silicone fluids include hexamethylcyclotrisiloxane, octamethylcyclotetrasiloxane, decamethylcyclopentasiloxane, dodecamethylcyclohexasiloxane, octamethyltrisiloxane, decamethyltetrasiloxane, dodecamethylpentasiloxane, tetradecamethylhexasiloxane, hexadeamethylheptasiloxane, heptamethyl-3-{(trimethylsilyl)oxy)}trisiloxane, hexamethyl-3,3, bis{(trimethylsilyl) oxy}trisiloxane pentamethyl{(trimethylsilyl) oxy}cyclotrisiloxane as well as polydimethylsiloxanes, polyethylsiloxanes, polymethylethylsiloxanes, polymethylphenylsiloxanes, polydiphenylsiloxanes, caprylyl methicone, hexamethyldisiloxane, heptamethyloctyltrisiloxane, hexyltrimethicone, and the like, as well as derivatives, modifications, and combinations thereof. Additional examples of silicone fluids include polyorganosiloxanes with vapor pressures of from $5\times10^{-7}$ to $1.5\times10^{-6}$ $m^2$/s.

Other carrier vehicles may also be utilized. For example, in some embodiments, the carrier vehicle comprises an ionic liquid. Examples of ionic liquids include anion-cation combinations. Generally, the anion is selected from alkyl sulfate-based anions, tosylate anions, sulfonate-based anions, bis (trifluoromethanesulfonyl)imide anions, bis(fluorosulfonyl) imide anions, hexafluorophosphate anions, tetrafluoroborate anions, and the like, and the cation is selected from imidazolium-based cations, pyrrolidinium-based cations, pyridinium-based cations, lithium cation, and the like. However, combinations of multiple cations and anions may also be utilized. Specific examples of the ionic liquids typically include 1-butyl-1-methylpyrrolidinium bis(trifluoromethanesulfonyl)imide, 1-methyl-1-propylpyrrolidinium bis-(trifluoromethanesulfonyl)imide, 3-methyl-1-propylpyridinium bis(trifluoromethanesulfonyl)imide, N-butyl-3-methylpyridinium bis(trifluoromethanesulfonyl)imide, 1-methyl-1-propylpyridinium bis(trifluoromethanesulfonyl)imide, diallyldimethylammonium bis(trifluoromethanesulfonyl)imide, methyltrioctylammonium bis(trifluoromethanesulfonyl)imide, 1-butyl-3-methylimidazolium bis(trifluoromethanesulfonyl)imide, 1,2-dimethyl-3-propylimidazolium bis(trifluoromethanesulfonyl)imide, 1-ethyl-3-methylimidazolium bis(trifluoromethanesulfonyl)imide, 1-vinylimidazolium.bis (trifluoromethanesulfonyl)imide, 1-allyl imidazolium bis (trifluoromethanesulfonyl)imide, 1-allyl-3-methylimidazolium bis(trifluoromethanesulfonyl)imide, lithium bis (trifluoromethanesulfonyl)imide, and the like, as well as derivatives, modifications, and combinations thereof.

In certain embodiments, the composition comprises (C) a solvent. The solvent (C) may facilitate introduction of certain components into the composition, mixing and/or homogenization of the components, etc. Likewise, the particular solvent (C) will be selected based on the solubility of components (A) and (B) and/or other components utilized in the composition, the volatility (i.e., vapor pressure) of the solvent, the end-use of the composition, etc. The solubility refers to the solvent (C) being sufficient to dissolve and/or disperse components (A) and (B) to form a homogenous composition. As such, solvents for use in the composition may generally be selected from any of the carrier vehicles described above suitable for fluidizing and/or dissolving components (A) and (B), or another component of the composition. As will be understood by those of skill in the art, while organic solvents may be utilized in the composition, such organic solvents will typically be removed before utilizing the composition, or an end-use composition comprising the same, especially if the organic solvents are flammable.

In certain embodiments, the solvent (C) is an aqueous solvent, and comprises, alternatively consists essentially of, alternatively is, water. The water is not particularly limited. For example, purified water such as distilled water and ion exchanged water, saline, a phosphoric acid buffer aqueous solution, and the like, or combinations and/or modifications thereof, can be used. In some such embodiments, the solvent (C) comprises water and at least one other solvent (i.e., a co-solvent), such as a water-miscible solvent. Examples of such co-solvents may include any of the water miscible carrier vehicles described above. Particular examples of co-solvents include glycerol, sorbitol, ethylene glycol, propylene glycol, hexylene glycol, polyethylene glycol (PEG), ethers of diethylene and dipropylene glycols (e.g. methyl, ethyl, propyl, and butyl ethers, etc.), and the like, as well as derivatives, modifications, and combinations thereof.

The amount of solvent (C) utilized is not limited, and depend on various factors, including the type of solvent selected, the amount and type of components (A) and (B) employed, the form of the composition (i.e., whether a concentrate, intermediate, or end-use composition), etc. Typically, the amount of solvent (C) utilized may range from 0.1 to 99.9 wt. %, based on the total weight of the composition, or the total combined weights of components (A), (B), and (C). In some embodiments, the solvent (C) is utilized in an amount of from 50 to 99.9 wt. %, such as from 60 to 99.9, alternatively of from 70 to 99.9, alternatively of from 80 to 99.9, alternatively of 90 to 99.9, alternatively of from 95 to 99.9, alternatively of from 98 to 99.9, alternatively of from 98.5 to 99.9, alternatively of from 98.5 to 99.7, alternatively of from 98.7 to 99.7 wt. %, based on the combined weights of components (A), (B), and (C). One of skill in the art that the upper limits of these ranges generally reflect the active amounts of components (A) and (B) utilized (i.e., in an end-use composition). As such, amounts outside these ranges may also be utilized.

In the composition, the siloxane cationic surfactant (A) and the organic cationic surfactant (B) may be used alone (i.e., neat or in combination with the solvent (C)), together with at least one auxiliary component, or as an auxiliary to at least one other component, optionally in the presence of one of more additives (e.g. agents, adjuvants, ingredients, modifiers, etc.). As such, in certain embodiments, the composition further comprises one or more additional components, such as one or more additives. It is to be appreciated that such additives may be classified under different terms of art and just because an additive is classified under such a term does not mean that it is thusly limited to that function. Moreover, some of these additives may be present in a particular component of the composition, or instead may be incorporated when forming the composition. Typically, the composition may comprise any number of additives, e.g. depending on the particular type and/or function of the same in the composition.

For example, in certain embodiments, the composition may comprise one or more additive components comprising, alternatively consisting essentially of, alternatively consisting of: (D) a surfactant (i.e., other than components (A) and (B)); (E) a rheology modifier; (F) a pH control agent; and (G) a foam enhancer.

In certain embodiments, the composition further comprises the surfactant (D). The surfactant (D) is a surfactant other than the cationic surfactants of components (A) and (B), and is otherwise not particularly limited. As such, the surfactant (D) may comprise one or more anionic, cationic, nonionic, and/or amphoteric surfactants, such as any one or more of those described below. In general, the surfactant (C) is selected to impart, alter, and/or facilitate certain properties of the composition and/or an end-use composition comprising the same, such as compatibility, foamability, foam stability, foam spreading and/or drainage (e.g. vapor sealing/containment), etc. In certain embodiments, the surfactant (D) is selected from water soluble surfactants.

In some embodiments, the surfactant (D) comprises, alternatively is, an ionic surfactant. Examples of anionic surfactants include carboxylates (sodium 2-(2-hydroxyalkyloxy)acetate)), amino acid derivatives (N-acylglutamates, N-acylgly-cinates or acylsarcosinates), alkyl sulfates, alkyl ether sulfates and oxyethylenated derivatives thereof, sulfonates, isethionates and N-acylisethionates, taurates and N-acyl N-methyltaurates, sulfosuccinates, alkylsulfoacetates, phosphates and alkyl phosphates, polypeptides, anionic derivatives of alkyl polyglycoside (acyl-D-galactoside uronate), and fatty acid soaps, alkali metal sulforicinates, sulfonated glyceryl esters of fatty acids such as sulfonated monoglycerides of coconut oil acids, salts of sulfonated monovalent alcohol esters such as sodium oleylisethianate, amides of amino sulfonic acids such as the sodium salt of oleyl methyl tauride, sulfonated products of fatty acids nitriles such as palmitonitrile sulfonate, sulfonated aromatic hydrocarbons such as sodium alpha-naphthalene monosulfonate, condensation products of naphthalene sulfonic acids with formaldehyde, sodium octahydroanthracene sulfonate, alkali metal alkyl sulfates such as sodium lauryl sulfate, ammonium lauryl sulfate and triethanol amine lauryl sulfate, ether sulfates having alkyl groups of 8 or more carbon atoms such as sodium lauryl ether sulfate, ammonium lauryl ether sulfate, sodium alkyl aryl ether sulfates, and ammonium alkyl aryl ether sulfates, alkylarylsulfonates having 1 or more alkyl groups of 8 or more carbon atoms, alkylbenzenesulfonic acid alkali metal salts exemplified by hexylbenzenesulfonic acid sodium salt, octylbenzenesulfonic acid sodium salt, decylbenzenesulfonic acid sodium salt, dodecylbenzenesulfonic acid sodium salt, cetylbenzenesulfonic acid sodium salt, and myristylbenzenesulfonic acid sodium salt, sulfuric esters of polyoxyethylene alkyl ether including $CH_3(CH_2)_6CH_2O(C_2H_4O)_2SO_3H$, $CH_3(CH_2)_7CH_2O(C_2H_4O)_{3.5}SO_3H$, $CH_3(CH_2)_8CH_2O(C_2H_4O)_8SO_3H$, $CH_3(CH_2)_{19}CH_2O(C_2H_4O)_4SO_3H$, and $CH_3(CH_2)_{10}CH_2O(C_2H_4O)_6SO_3H$, sodium salts, potassium salts, and amine salts of alkylnaphthylsulfonic acid, and the like, as well as derivatives, modifications, and combinations thereof.

In some embodiments, the surfactant (D) comprises, alternatively is, a cationic surfactant. Examples of cationic surfactants include various fatty acid amines and amides and their derivatives, and the salts of the fatty acid amines and amides. Examples of aliphatic fatty acid amines include dodecylamine acetate, octadecylamine acetate, and acetates of the amines of tallow fatty acids, homologues of aromatic amines having fatty acids such as dodecylanalin, fatty amides derived from aliphatic diamines such as undecylimidazoline, fatty amides derived from aliphatic diamines such asundecylimidazoline, fatty amides derived from disubstituted amines such as oleylaminodiethylamine, derivatives of ethylene diamine, quaternary ammonium compounds and their salts which are exemplified by tallow trimethyl ammonium chloride, dioctadecyldimethyl ammonium chloride, didodecyldimethyl ammonium chloride, dihexadecyl ammonium chloride, alkyltrimethylammonium hydroxides such as octyltrimethylammonium hydroxide, dodecyltrimethylammonium hydroxide, and hexadecyltrimethylammonium hydroxide, dialkyldimethylammonium hydroxides such as octyldimethylammonium hydroxide, decyldimethylammonium hydroxide, didodecyldimethylammonium hydroxide, dioctadecyldimethylammonium hydroxide, tallow trimethylammonium hydroxide, coconut oil, trimethylammonium hydroxide, methylpolyoxyethylene cocoammonium chloride, and dipalmitylhydroxyethylammonium methosulfate, amide derivatives of amino alcohols such as beta-hydroxylethylstearylamide, amine salts of long chain fatty acids, and the like, as well as derivatives, modifications, and combinations thereof.

In some embodiments, the surfactant (D) comprises, alternatively is, a nonionic surfactant. Examples of nonionic surfactants include polyoxyethylene alkyl ethers (such as, lauryl, cetyl, stearyl or octyl), polyoxyethylene alkylphenol ethers, polyoxyethylene lauryl ethers, polyoxyethylene sorbitan monoleates, polyoxyethylene alkyl esters, polyoxyethylene sorbitan alkyl esters, polyethylene glycol, polypropylene glycol, diethylene glycol, ethoxylated trimethylnonanols, polyoxyalkylene glycol modified polysiloxane surfactants, polyoxyalkylene-substituted silicones (rake or ABn types), silicone alkanolamides, silicone esters, silicone glycosides, dimethicone copolyols, fatty acid esters of polyols, for instance sorbitol and glyceryl mono-, di-, tri- and sesqui-oleates and stearates, glyceryl and polyethylene glycol laurates; fatty acid esters of polyethylene glycol (such as polyethylene glycol monostearates and monolaurates), polyoxyethylenated fatty acid esters (such as stearates and oleates) of sorbitol, and the like, as well as derivatives, modifications, and combinations thereof.

In some embodiments, the surfactant (D) comprises, alternatively is, an amphoteric surfactant. Examples of amphoteric surfactants include amino acid surfactants, betaine acid surfactants, trimethylnonyl polyethylene glycol ethers and polyethylene glycol ether alcohols containing linear alkyl groups having from 11 to 15 carbon atoms, such as 2,6,8-trimethyl-4-nonyloxypolyethylene oxyethanol (6 EO) (sold as Tergitol® TMN-6 by OSi Specialties, A Witco Company, Endicott, N.Y.), 2,6,8-trimethyl-4-nonyloxypolyethylene oxyethanol (10 EO) (sold as Tergitol® TMN-10 by OSi Specialties, A Witco Company, Endicott, N.Y.), alkylene-oxypolyethylene oxyethanol ($C_{11-15}$ secondary alkyl, 9 EO) (sold as Tergitol®15-S-9 by OSi Specialties, A Witco Company, Endicott, N.Y.), alkylene-oxypolyethylene oxyethanol ($C_{11-15}$ secondary alkyl, 15 EO) (sold as Tergitol®15-S-15 by OSi Specialties, A Witco Company, Endicott, N.Y.), octylphenoxy polyethoxy ethanols having varying amounts of ethylene oxide units such as octylphenoxy polyethoxy ethanol (40 EO) (sold as Triton® X405 by Rohm and Haas Company, Philadelphia, Pa.), nonionic ethoxylated tridecyl ethers available from Emery Industries, Mauldin, S.C. under the general tradename Trycol, alkali metal salts of dialkyl sulfosuccinates available from American Cyanamid Company, Wayne, N.J. under the general tradename Aerosol, polyethoxylated quaternary ammonium salts and ethylene oxide condensation products of the primary fatty amines (available from Armak Company, Chicago, Ill. under the tradenames Ethoquad, Ethomeen, or Arquad), polyoxyalkylene glycol modified polysiloxanes, N-alkylamidobetaines and derivatives thereof, proteins and derivatives thereof, glycine derivatives, sultaines, alkyl polyaminocarboxylates and alkylamphoacetates, and the like, as well as derivatives, modifications, and combinations thereof. These surfactants may also be obtained from other suppliers under different tradenames.

The surfactant (D) may be included in the composition are varying concentrations, e.g. depending on the particular form thereof, the particular surfactant(s) selected for the surfactant (D), the loading/active amounts of components (A) and/or (B), etc. Typically, the surfactant (D) is utilized in an amount of from greater than 0 to 10, alternatively from 0.01 to 5, alternatively from 0.01 to 3 wt. %, based on the total weight of the composition, or an end-use composition comprising the same.

In certain embodiments, the composition further comprises the rheology modifier (E). The rheology modifier (E) is not particularly limited, and is generally selected to alter the viscosity, flow property, and/or a foaming property (i.e., foam-forming ability and/or foam stability) of the composition, or an end-use composition comprising the same. As such, the rheology modifier (E) is not particular limited, and may comprise a thickener, stabilizer, viscosity modifier, thixotropic agent, etc., or combinations thereof, which will be generally selected from natural or synthetic thickening compounds. In some embodiments, the rheology modifier (E) comprises one or more water soluble and/or water compatible thickening compounds (e.g. water-soluble organic polymers, etc.).

Examples of compounds suitable for use in or as the rheology modifier (E) include acrylamide copolymers, acrylate copolymers and salts thereof (e.g. sodium polyacrylates, etc.), celluloses (e.g. methylcelluloses, methylhydroxypropylcelluloses, hydroxyethylcelluloses, hydroxypropylcelluloses, polypropylhydroxyethylcelluloses, carboxymethylcelluloses, etc.), starches (e.g. starch, hydroxyethylstarch, etc.), polyoxyalkylenes (e.g. PEG, PPG, PEG/PPG copolymers, etc.), carbomers, alginates (e.g. sodium alginate), various gums (e.g. arabic gums, cassia gums, carob gums, scleroglucan gums, xanthan gums, gellan gums, rhamsan gums, karaya gums, carrageenan gums, guar gums, etc.), cocamide derivatives (e.g. cocamidopropyl betaines, etc.), medium to long-chain alkyl and/or fatty alcohols (e.g. cetearyl alcohol, stearyl alcohol, etc.), gelatin, saccharides (e.g. fructose, glucose, PEG-120 methyl glucose diolate, etc.), and the like, as well as derivatives, modifications, and combinations thereof.

In certain embodiments, the composition comprises the pH control agent (F). The pH control agent (F) is not particular limited, and may comprise or be any compound suitable for modifying or adjusting the pH of the composition and/or maintaining (e.g. regulating) the pH of the composition in a particular range. As such, as will be understood by those of skill in the art, the pH control agent (F) comprises, alternatively is a pH modifier (e.g. an acid and/or a base), a pH buffer, or a combination thereof, such as any one or more of those described below.

Examples of acids generally include mineral acids (e.g. hydrochloric acid, phosphoric acid, sulfuric acid, etc.), organic acids (e.g. citric acid, etc.), and the like, as well as derivatives, modifications, and combinations thereof.

Examples of bases generally include alkali metal hydroxides (e.g. sodium hydroxide, potassium hydroxide, etc.), carbonates (e.g. alkali metal carbonate salts such as sodium carbonate, etc.), phosphates, and the like, as well as derivatives, modifications, and combinations thereof.

In certain embodiments, the pH control agent (F) comprises, alternatively is, the pH buffer. Suitable pH buffers are not particularly limited, and may comprise, alternatively may be, any buffering compound capable of adjusting the pH of the composition and/or maintaining (e.g. regulating) the pH of the composition in a particular range. As will be understood by those of skill in the art, examples of suitable buffers and buffering compounds may overlap with certain pH modifiers, including those described above, due to the overlap in functions between the additives. As such, when both are utilized in or as the pH control agent (F), the pH buffer and the pH modifier may be independently or collectively selected in view of each other.

In general, suitable pH buffers are selected from buffering compounds that include an acid, a base, or a salt (e.g. comprising the conjugate base/acid of an acid/base). Examples of buffering compounds generally include alkali metal hydroxides (e.g. sodium hydroxide, potassium hydroxide, etc.), carbonates (e.g. sesquicarbonates, alkali metal carbonate salts such as sodium carbonate, etc.), borates, silicates, phosphates, imidazoles, citric acid, sodium citrate, and the like, as well as derivatives, modifications, and combinations thereof. Examples of the some pH buffers include citrate buffers, glycerol buffers, borate buffers, phosphate buffers, and combinations thereof (e.g. citric acid-phosphate buffers, etc.). As such, some examples of particular buffering compounds suitable for use in or as the pH buffer of the pH control agent (F) include ethylenediaminetetraacetic acids (e.g. disodium EDTA, etc.), triethanolamines (e.g. tris(2-hydroxyethyl)amine, etc.), citrates and other polycarboxylic acid-based compounds, and the like, as well as derivatives, modifications, and combinations thereof.

In some embodiments, the composition comprises the foam enhancer (G). Particular compounds/compositions suitable for use in or as the foam enhancer (G) are not limited, and generally include those capable of imparting, enhancing, and or modifying a foaming property (e.g. foamability, foam stability, foam drainage, foam spreadability, foam density, etc.) of the composition, or an end-use composition comprising the same. As such, one of skill in the art will readily appreciate that compounds/compositions suitable for use in or as the foam enhancer (G) may overlap with those described herein with respect to other additives/components of the composition.

For example, in certain embodiments, the foam enhancer (G) comprises a stabilizing agent selected from electrolytes (e.g. alkali metal and/or alkaline earth salts of various anions, such as chloride, borate, citrate, and/or sulfate salts of sodium, potassium, calcium, and/or magnesium, aluminum chlorohydrates, etc.), polyelectrolytes (e.g. hyaluronic acid salts, such as sodium hyaluronates, etc.), polyols (e.g. glycerine, propylene glycols, butylene glycols, sorbitols), hydrocolloids, and the like, as well as derivatives, modifications, and combinations thereof.

In certain embodiments, the foam enhancer (G) comprises a saccharide compound, i.e., a compound comprising at least one saccharide moiety. It is to be appreciated that the term "saccharide" may be used synonymously with the term "carbohydrate" under general circumstances, and terms like "sugar" under more specific circumstances. As such, the nomenclature of any particular saccharide is not exclusionary with regard to suitable saccharide compounds for use in or as the foam enhancer (G). Rather, as will be understood by those of skill in the art, suitable saccharide compounds may include, alternatively may be, any compound comprising a moiety that can be described as a saccharide, carbohydrate, sugar, starch, cellulose, and the like, or a derivative or modification thereof, or combinations thereof. Likewise, any combination of more than one saccharide moiety in the saccharide compounds may be described more descriptive terms. For example, the term "polysaccharide" may be used synonymously with the term "glycoside," where both terms generally refer to a combination of more than one saccharide moiety (e.g. where the combination of saccharide moieties are linked together via glycosidic linkage(s) and collectively form a glycoside moiety). One of skill in the art will appreciate that terms such as "starch" and "cellulose" may be used to refer to such combinations of saccharide moieties under specific circumstances (e.g. when a combination of more than one saccharide moiety in the saccharide compound conforms to the structure known in the art as a "starch" or a "cellulose", etc.).

As such, examples of saccharide compounds suitable for use in or as the foam enhancer (G) may include compounds, or compounds comprising at least one moiety, conventionally referred to as a monosaccharide and/or sugar (e.g. pentoses (i.e., furanoses), such as riboses, xyloses, arabinoses, lyxoses, fructoses, etc., and hexoses (i.e., pyranoses), such as glucoses, galactoses, mannoses, guloses, idoses, taloses, alloses, altroses, etc.), a disaccharide (e.g. sucroses, lactoses, maltoses, trehaloses, etc.), an oligosaccharide (e.g. malto-oligosaccharides, such as maltodextrins, arafinoses, stachyoses, fructooligosaccharides, etc.), a polysaccharide (e.g. celluloses, hemicelluloses, pectins, glycogens, hydrocolloids, starches such as amyloses, amylopectins, etc.), or the like, or a combination thereof.

Other examples of foam enhancers suitable for use in or as the foam enhancer (G) are known in the art. For example, the foam enhancer (G) may comprise a polymeric stabilizer, such as those comprising a polyacrylic acid salt, a modified starch, a partially hydrolyzed protein, a polyethyleneimine, a polyvinyl resin, a polyvinyl alcohol, a polyacrylamids, a carboxyvinyl polymer, or combinations thereof. In these or other embodiments, the foam enhancer (G) may comprise a thickener, such as those comprising one or more gums (e.g. xanthan gum), collagen, galactomannans, starches, starch derivatives and/or hydrolysates, cellulose derivatives (e.g. methyl cellulose, hydroxypropylcellulose, hydroxyethyl cellulose, hydroxypropyl methyl cellulose, etc.), colloidal silicic acids, polyvinyl alcohols, vinylpyrrolidone-vinylacetate-copolymers, polyethylene glycols, polypropylene glycols, or the like, or a derivative, modification, or combination thereof.

The composition may comprise one or more additional components/additives, i.e., other than those described above, which are known in the art and will be selected based on the particular components utilized in the composition and a desired end-use thereof. For example, the composition may comprise: a filler; a filler treating agent; a surface modifier; a binder; a compatibilizer; a colorant (e.g. a pigment, dye, etc.); an anti-aging additive; a flame retardant; a corrosion inhibitor; a UV absorber; an anti-oxidant; a light-stabilizer; a heat stabilizer; and the like, as well as derivatives, modifications, and combinations thereof.

The composition may be prepared by combining components (A) and (B), as well as any optional components (e.g. components (C)-(G) described above), in any order of addition, optionally with a master batch, and optionally under mixing.

In certain embodiments, the composition is prepared by pre-mixing component (A) with an optional component to prepare an intermediate composition that is subsequently combined with component (B) to prepare the composition. Likewise, in these or other embodiments, the composition is prepared by pre-mixing component (B) with an optional component to prepare an intermediate composition that is subsequently combined with component (A) to prepare the composition. For example, in certain embodiments, component (A) is combined with the pH control agent (F) to prepare a siloxane cationic surfactant composition, which is subsequently combined with component (B) to prepare the composition. In some such embodiments, the pH control agent (F) is a mineral acid (e.g. HCl) and utilized in an amount sufficient to protonate some, but not all, amine groups of the siloxane cationic surfactant (A), thereby preparing the siloxane cationic surfactant composition as a buffer solution. In these or other embodiments, component (B) is combined with the pH control agent (F) to prepare an organic cationic surfactant composition, which is subsequently combined with component (A) (e.g. independently, in the form of the siloxane cationic surfactant composition, etc.) to prepare the composition. In some such embodiments, the pH control agent (F) is a mineral acid (e.g. HCl) and utilized in an amount sufficient to protonate some, but not all, amine groups of the organic cationic surfactant (B), thereby preparing the organic cationic surfactant composition as a buffer solution. In view of the embodiments above, one of skill in the art will appreciate that the pH control agent (F) may comprise multiple functions, such as to adjust the pH of one or more individual components of the composition, to buffer one or more intermediate compositions, and/or to modify, control, and/or buffer the pH of the composition by itself or in combination with one or more other components.

The composition may be prepared as a concentrate, e.g. via combining components (A) and (B), optionally together with any of components (D)-(G), with minimal or no amount of component (C). Alternatively, when formulated for dilution, the composition may comprise a predominate amount of component (C) (e.g. >50, alternatively>75, alternatively>90 wt. %, based on the total weight of the composition), and still be defined as a concentrate.

The foam stabilizing composition may be formulated as a foam-forming composition (e.g. via diluting a concentrated of the composition, as described above) or utilized as an additive to prepare a foam-forming composition (e.g. via combining the foam stabilizing composition with a base formulation, i.e., a formulation comprising foaming agents, solvents/carriers, additives, etc.). For example, the foaming composition can be prepared by providing water (e.g. as an active flow from a hose, pipe, etc., or in a reaction vessel/reactor), optionally combined with one or more foam additives, and combining the foam stabilizing composition with the water (e.g. as a pre-formed mixture, via addition individual components (A), (B), (C), etc.). In either of such instances, the foam-forming composition comprising the foam stabilizing composition, once prepared, may be aerated or otherwise expanded (e.g. via foaming equipment, application to an aerated water stream/flow, etc.) to form a foam composition (i.e., a "foam").

The foam prepared with the foam stabilizing composition is suitable for use in various applications. For example, as introduced above, the composition may be utilized in an aqueous film-forming foam (AFFF), or similar such foam, which may be utilized in extinguishing, suppressing, and/or preventing fire. In particular, due to the increased stability provided by the composition, foams prepared therewith may be used for extinguishing fires involving chemicals with low boiling points, high vapor pressures, and/or limited aqueous solubility (e.g. gasoline, organic solvents, etc.), which are typically extremely flammable and/or difficult to maintain/extinguish. For example, such a fire may be extinguished by contacting the fire with foam (e.g. by spraying the foam onto the fire, spraying the foam-forming composition over the fire to prepare the foam thereon, etc.). In similar fashion, the foam may be utilized to secure chemicals (e.g. from a spill or leak thereof) to limit vapor leak and/or ignition, by the applying the foam to the top of the spill/leak, or otherwise forming the foam thereon.

The following examples, illustrating embodiments of this disclosure, are intended to illustrate and not to limit the invention.

Certain components utilized in the Examples are set forth in Table 1 below, which is followed by a brief summary including information regarding certain abbreviations, shorthand notations, structural/chemical descriptions, etc., of particular components utilized in the Examples. With regard to chemical structures, it will be understood that each terminal pendant group not expressly shown is a methyl group (—$CH_3$) unless otherwise indicated.

TABLE 1

| Components and Materials Utilized | |
|---|---|
| Component | Description |
| Siloxane C.S. (A1) | Si4-QUAB; a siloxane cationic surfactant prepared according to Preparation Example 1 below, having the following formula: |

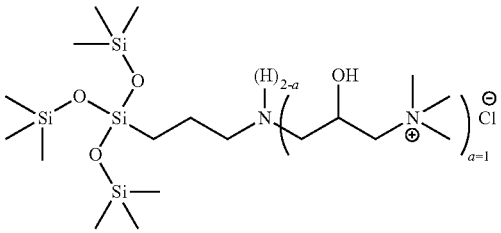

TABLE 1-continued

| Components and Materials Utilized | |
|---|---|
| Component | Description |
| Siloxane C.S. (A2) | Si4-$(QUAB)_{1.5}$; a siloxane cationic surfactant prepared according to Preparation Example 2 below, having the following formula: 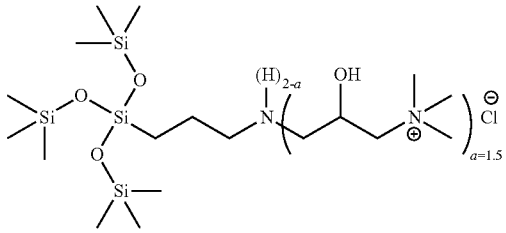 |
| Siloxane C.S. (A3) | Si7-PDA-$(QUAB)_{1.5}$; a siloxane cationic surfactant prepared according to Preparation Example 3 below, having the following formula: 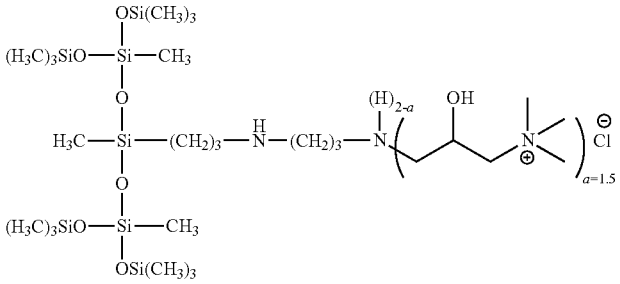 |
| Organic C.S. (B1) | C6-QUAB; an organic cationic surfactant prepared according to Preparation Example 4 below, having the following formula: 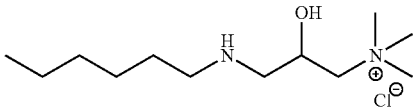 |
| Organic C.S. (B2) | C8-QUAB; an organic cationic surfactant prepared according to Preparation Example 5 below, having the following formula: 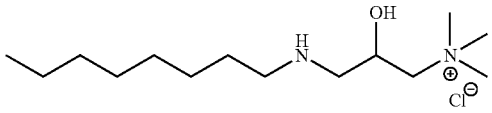 |
| Organic C.S. (B3) | C10-QUAB; an organic cationic surfactant prepared according to Preparation Example 6 below, having the following formula: 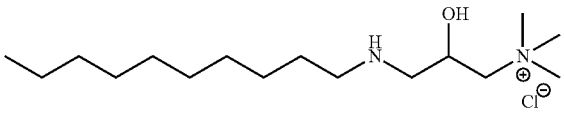 |
| Solvent (C1) | Water |
| Surfactant (D1) | C8-10 alkyl polyglycosides nonionic surfactant |
| Surfactant (D2) | Sodium decyl ethoxy sulphate anionic surfactant |
| Surfactant (D3) | Sodium Lauroamphoacetate amphoteric surfactant |
| Surfactant (D4) | N,N-dimethylhydroxyethyl cellulose cationic surfactant |
| Surfactant (D5) | Coco-glucoside nonionic surfactant |
| pH Control Agent (F1) | 2N hydrochloric acid (HCl) |
| pH Control Agent (F2) | Bis(2-hydroxyethyl)amino-tris(hydroxymethyl)methane (BIS-TRIS) buffer |
| Foam Enhancer (G1) | Lactose monohydrate |
| Foam Enhancer (G2) | Brown sugar |
| Foam Enhancer (G3) | Starch |
| Foam Enhancer (G4) | Xanthan gum |
| Foam Enhancer (G5) | Dextrose |

Preparation Example 1: Preparation of Si4-QUAB

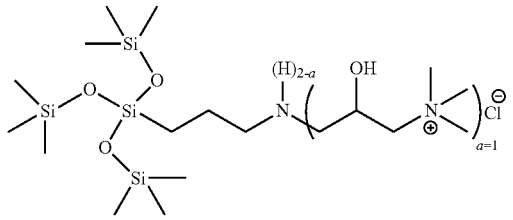

3-aminopropyltris(trimethylsiloxy)silane (6.34 g), glycidyltrimethylammonium chloride (4.09 g; 72.7% solution in water), ethanol (5.50 g), and HCl (0.66 g; 0.1N) are mixed in a 1 oz vial and stirred on a 60° C. heating block to give a mixture, which turns clear within ~9 minutes. The mixture is stirred for 1 hour and 40 minutes, then pH Control Agent (F1) (3.10 g) is added and the solution stirred at RT for 1 hour to give a composition comprising a siloxane cationic surfactant (Si4-QUAB; 47.1% concentration).

Preparation Example 2: Preparation of Si4-$(QUAB)_{1.5}$

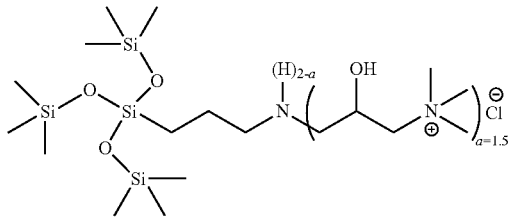

3-aminopropyltris(trimethylsiloxy)silane (6.35 g), glycidyltrimethylammonium chloride (6.01 g; 1.5 eq.; 72.7% solution in water), ethanol (5.86 g), and HCl (1.5 g; 0.1N) are mixed in a 1 oz vial and stirred on a 60° C. heating block to give a mixture, which turns clear within ~15 minutes. The mixture is stirred for 1 hour and 40 minutes, then pH Control Agent (F1) (3.09 g) is added and the solution stirred at RT for 1 hour to give a composition comprising a siloxane cationic surfactant (Si4-$(QUAB)_{1.5}$; adjusted to 40% concentration with water).

Preparation Example 3: Preparation of Si7-PDA-$(QUAB)_{1.5}$

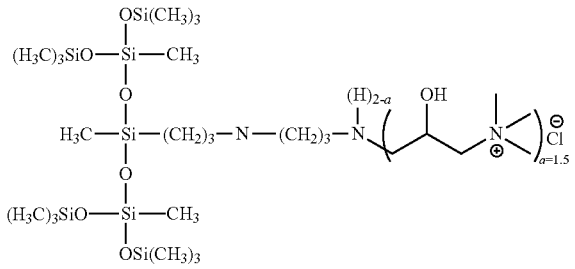

1,1,1,3,5,5,5-Heptamethyltrisiloxane (255 g) is charged to a 500 mL 4-neck flask equipped with a thermal couple, mechanical stirrer, and water-cooled condenser adapted to a $N_2$ bubbler. Tris(pentafluorophenyl)borane (BCF; 50 ppm) is then added to the flask. 3-chloropropylmethyldimethoxysilane (96.3 g, Gelest, Inc.) and BCF (150 ppm) are mixed in an addition funnel to form a catalyzed mixture, which is then slowly added into the flask over 30 minutes while an ice water bath is used to remove heat and control the pot temperature to below 30° C. The mixture is then stirred for 1 hour at room temperature, at which time $^1H$ NMR indicates that conversion is >99%. The mixture is then concentrated with a rotary evaporator (110° C.; 1 torr; 30 minutes) to give a first intermediate (Si7PrCl).

Two 20 mL sample vials are each charged with 1,3-diaminopropane (5.62 g) and Si7PrCl (14.59 g), then heated to 120° C. and mixed for ~15 hours. Each mixture is then cooled to room temperature and combined in a 500 mL glass sample jar for a total of 39.17 g of reaction solution. DI water (38.72 g) and heptane (37.80 g) are added the jar, and the biphasic mixture stirred with the jar left uncapped to avoid pressure build up. The sample is then allowed to rest until the two-phase solution fully separates. The top layer is then removed via syringe, filtered through a syringe filter (2.0 μm) into a flask, and stripped via simple distillation (60° C. and ~20 mmHg) to remove heptane and give a second intermediate ("Si7-PDA").

Si7-PDA (2.18 g), glycidyltrimethylammonium chloride (0.88 g; 1.5 eq.; 72.7% solution in water), ethanol (3.00 g), and HCl (0.08 g; 0.1N) are mixed in a 1 oz vial and stirred on a 50° C. heating block to give a mixture, which turns clear immediately. The mixture is stirred for 3 hours, then pH Control Agent (F1) (1.12 g) is added and the solution stirred at RT for 1 hour to give a composition comprising a siloxane cationic surfactant (Si7-PDA-$(QUAB)_{1.5}$; 39.3 wt. % concentration).

Preparation Example 4: Preparation of C6-QUAB

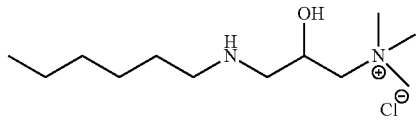

1-hexylamine (2.82 g), glycidyltrimethylammonium chloride (6.21 g; 72.7% solution in water), ethanol (5.02 g), and HCl (1.35 g; 0.1N) are mixed in a 1 oz vial and stirred on a 60° C. heating block to give a mixture, which turns clear within ~2 minutes. The mixture is stirred for 2.5 hours, then pH Control Agent (F1) (4.69 g) is added and the solution stirred at RT for 1 hour to give a composition comprising a cationic surfactant (C6-QUAB; 36.7% concentration).

Preparation Example 5: Preparation of C8-QUAB

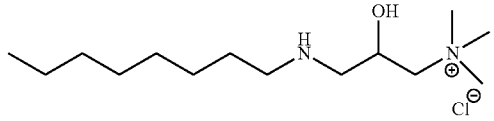

1-octylamine (3.60 g), glycidyltrimethylammonium chloride (6.21 g; 72.7% solution in water), ethanol (5.04 g), and HCl (1.35 g; 0.1N) are mixed in a 1 oz vial and stirred on a 60° C. heating block to give a mixture, which turns clear within ~3 minutes. The mixture is stirred for 2.5 hours, then pH Control Agent (F1) (4.76 g) is added and the solution stirred at RT for 1 hour to give a composition comprising a cationic surfactant (C8-QUAB; 38.6 wt. % concentration).

Preparation Example 6: Preparation of C10-QUAB

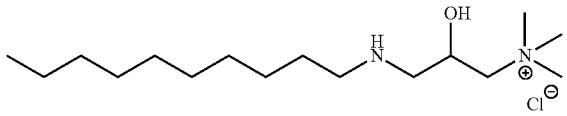

1-decylamine (4.38 g), glycidyltrimethylammonium chloride (6.19 g; 72.7% solution in water), ethanol (5.00 g), and HCl (1.35 g; 0.1N) are mixed in a 1 oz vial and stirred on a 60° C. heating block to give a mixture, which turns clear within ~4 minutes. The mixture is stirred for 2.5 hours, then pH Control Agent (F1) (4.72 g) is added and the solution stirred at RT for 1 hour to give a composition comprising a cationic surfactant (C10-QUAB; 40.8 wt. % concentration).

Preparation Procedure 1: Foam Stabilizing Composition

A foam stabilizing composition is prepared by combining together a Siloxane Cationic Surfactant (A) and an Organic Cationic Surfactant (B). In particular, a Siloxane Cationic Surfactant (A), an Organic Cationic Surfactant (B), and optionally a pH Control Agent (F), a Surfactant (D), and/or a Foam Enhancer (G), are combined with and diluted in a Solvent (C) in a sample vial to give a foam stabilizing composition, which may be visually analyzed to assess appearance.

Preparation Procedure 2: Foam

A foam is prepared by aerating a foam stabilizing composition. In particular, a foam stabilizing composition is prepared in a sample vial according to Preparation Procedure 1 above. The sample vial is then shaken for ~5 sec to prepare a foam, which may be visually analyzed to assess relative foam amount and thickness.

Analysis Procedure 1: Foam Stability Over Heptane at 35° C.

A 10 mL sample vial is charged with heptane (~3 g) and placed uncapped on a heating block stable at 35° C. for 15 min. A sample of foam (~3 cm) prepared according to Preparation Procedure 2 above is then transferred via pipette onto the heated heptane to give a foam layer. A timer is started upon completion of the foam transfer, and stopped once the foam layer is broken, dissolved, or popped, and the time recorded provided as the 35° C. Foam Stability over Heptane of the foam sampled.

Analysis Procedure 2: Foam Stability over Heptane at 60° C.

The procedure Foam Analysis 1 above is performed using a heating block stable at 60° C. The time for the given foam layer to become broken, dissolved, or popped is recorded as the 60° C. Foam Stability over Heptane of the foam sampled.

Examples 1-12: Foam Stabilizing Compositions and Foams Prepared Therewith

Various foam stabilizing compositions are prepared according to Preparation Procedure 1 above using Siloxane Cationic Surfactant (A1), Organic Cationic Surfactant (B1), Solvent (C1), and, optionally, various additive components. Particular components and parameters of Examples 1-12 are set forth in Tables 2-3 below.

TABLE 2

Components and Parameters of Examples 1-6

| Component | Ex. 1 | Ex. 2 | Ex. 3 | Ex. 4 | Ex. 5 | Ex. 6 |
|---|---|---|---|---|---|---|
| Siloxane C.S. (A1) (wt. %): | 0.3 | 0.3 | 0.3 | 0.3 | 0.3 | 0.3 |
| Organic C.S. (B1) (wt. %): | 0.5 | 0.5 | 0.5 | 0.5 | 0.5 | 0.5 |
| Surfactant (D): | N/A | D1 | D2 | D3 | D4 | D5 |
| Amount (D) (wt. %): | — | 0.5 | 0.5 | 0.5 | 0.5 | 0.5 |
| Foam Enhancer (G): | N/A | N/A | N/A | N/A | N/A | N/A |
| Amount (G) (wt. %): | — | — | — | — | — | — |
| pH Control Agent (F): | N/A | N/A | N/A | N/A | N/A | N/A |
| Amount (F) (wt. %): | — | — | — | — | — | — |

TABLE 3

Components and Parameters of Examples 7-12

| Component | Ex. 7 | Ex. 8 | Ex. 9 | Ex. 10 | Ex. 11 | Ex. 12 |
|---|---|---|---|---|---|---|
| Siloxane C.S. (A1) (wt. %): | 0.3 | 0.3 | 0.3 | 0.3 | 0.3 | 0.3 |
| Organic C.S. (B1) (wt. %): | 0.5 | 0.5 | 0.5 | 0.5 | 0.5 | 0.5 |
| Surfactant (D): | N/A | N/A | N/A | N/A | N/A | N/A |
| Amount (D) (wt. %): | — | — | — | — | — | — |
| Foam Enhancer (G): | G1 | G2 | G3 | G4 | G5 | N/A |
| Amount (G) (wt. %): | 0.5 | 0.5 | 0.5 | 0.5 | 0.5 | — |
| pH Control Agent (F): | N/A | N/A | N/A | N/A | N/A | F2 |
| Amount (F) (wt. %): | — | — | — | — | — | 0.5 |

The foam stabilizing compositions are then utilized in the preparation of various foams according to Preparation Procedure 2 above, and the resulting foams analyzed for stability over volatile organic solvent according to Analysis Procedure 1 above. The results of the analyses are set forth in Table 4 below.

TABLE 4

Foam Analysis Results of Examples 1-12

| Example | Foam Performance | 35° C. Foam Stability (min.) |
|---|---|---|
| Ex. 1 | Good | 27 |
| Ex. 2 | Good | 2 |
| Ex. 3 | Poor | N/A |
| Ex. 4 | Good | 2 |
| Ex. 5 | Less foam; thick | 58 |
| Ex. 6 | Good | 4 |
| Ex. 7 | Good | 49 |
| Ex. 8 | Good | 38 |
| Ex. 9 | Good | 38 |
| Ex. 10 | Less foam; very thick | >180 |
| Ex. 11 | Good | 40 |
| Ex. 12 | Good | 30 |

As shown in Table 4, the exemplary compositions provide good foam performance and stability (e.g. see Example 1), which may be further enhanced with addition of various additive components including another surfactants (e.g. see Example 5), a sugar or other carbohydrate foam enhancers (e.g. see Examples 7-11), and a buffer (e.g. see Example 12).

Examples 13-16: Foam Stabilizing Compositions and Foams Prepared Therewith

Various foam stabilizing compositions are prepared according to Preparation Procedure 1 above using Siloxane Cationic Surfactant (A1), Solvent (C1), and various Organic Cationic Surfactants (B). The foam stabilizing compositions are then utilized in the preparation of various foams according to Preparation Procedure 2 above, and the resulting foams analyzed for stability over volatile organic solvent according to Analysis Procedure 1 above. The results of the analyses are set forth in Table 5 below, along with particular components and parameters of Examples 13-16.

TABLE 5

Components, Parameters, and Results of Examples 13-16

| Component | Ex. 13 | Ex. 14 | Ex. 15 | Ex. 16 |
|---|---|---|---|---|
| Siloxane C.S. (A): | A1 | A1 | A1 | A1 |
| Amount (A) (wt. %): | 0.3 | 0.3 | 0.3 | 0.3 |
| Organic C.S. (B) (wt. %): | B1 | B1 | B2 | B3 |
| Amount (B) (wt. %): | 0.5 | 0.5 | 0.5 | 0.5 |
| 35° C. Foam Stability (min.): | 27 | 20 | 74 | 37 |

As shown in Table 5, the exemplary compositions provide good foam performance and stability using various Organic Cationic Surfactants (B) (e.g. see Examples 13-16), with particular combinations of Siloxane Cationic Surfactants (A) and Organic Cationic Surfactants (B) providing additional stability benefits (e.g. see Example 15).

Examples 17-19: Foam Stabilizing Compositions and Foams Prepared Therewith

Various foam stabilizing compositions are prepared according to Preparation Procedure 1 above using Organic Cationic Surfactant (B1), Solvent (C1), and various Siloxane Cationic Surfactants (A). The foam stabilizing compositions are then utilized in the preparation of various foams according to Preparation Procedure 2 above, and the resulting foams analyzed for stability over volatile organic solvent according to Analysis Procedure 2 above. The results of the analyses are set forth in Table 6 below, along with particular components and parameters of Examples 17-19.

Comparative Examples 1-3: Comparative Foam Compositions and Foams

Various foam compositions are prepared according to Preparation Procedure 1 above using Solvent (C1) and various Siloxane Cationic Surfactants (A), without any addition of an Organic Cationic Surfactant (B). The foam compositions are then utilized in the preparation of various foams, if foamable, according to Preparation Procedure 2 above, and the resulting foams analyzed for stability over volatile organic solvent according to Analysis Procedure 2 above. The results of the analyses are set forth in Table 6 below, along with particular components and parameters of Comparative Examples 1-3.

TABLE 6

Components, Parameters, and Results of Examples 17-19 and Comparative Examples 1-3

| Component | Ex. 17 | Comp. Ex. 1 | Ex. 18 | Comp. Ex. 2 | Ex. 19 | Comp. Ex. 3 |
|---|---|---|---|---|---|---|
| Siloxane C.S. (A): | A1 | A1 | A2 | A2 | A3 | A3 |
| Amount (A) (wt. %): | 0.3 | 0.3 | 0.3 | 0.3 | 0.3 | 0.3 |
| Organic C.S. (B) (wt. %): | B2 | N/A | B2 | N/A | B2 | N/A |
| Amount (B) (wt. %): | 0.5 | — | 0.5 | — | 0.5 | — |
| 60° C. Foam Stability (min.:sec.): | 21:38 | 4:51 | 31:58 | 14:00 | 1:21 | N/A |

As shown in Table 6, the exemplary compositions provide good foam performance and stability using various Siloxane Cationic Surfactants (A) (e.g. see Examples 17-19). Moreover, as compared with foam compositions containing only one cationic surfactant (e.g. see Comparative Examples 1-3), the exemplary compositions using combinations of Siloxane Cationic Surfactants (A) and Organic Cationic Surfactants (B) providing greatly enhanced stability to foams prepared therewith (e.g. see Examples 17-19).

Examples 20-29: Foam Stabilizing Compositions and Foams Prepared Therewith

Various foam stabilizing compositions are prepared according to Preparation Procedure 1 above using varying amounts of Siloxane Cationic Surfactant (A1) and Organic Cationic Surfactant (B2) in Solvent (C1). The foam stabilizing compositions are then utilized in the preparation of various foams according to Preparation Procedure 2 above, and the resulting foams analyzed for stability over volatile organic solvent according to Analysis Procedure 2 above. The results of the analyses are set forth in Table 7 below, along with particular parameters of Examples 20-29.

TABLE 7

Parameters and Results of Examples 20-29

| Example | Siloxane C.S. A1 (wt. %) | Organic C.S. B2 (wt. %) | Ratio A1: B2 | Appearance | 60° C. Foam Stability (min.) |
|---|---|---|---|---|---|
| Ex. 20 | 0.1 | 0.2 | 0.5 | Clear | 5 |
| Ex. 21 | 0.3 | 0.2 | 1.5 | Slightly Hazy | 19 |
| Ex. 22 | 0.5 | 0.2 | 2.5 | Hazy | 20 |
| Ex. 23 | 0.7 | 0.2 | 3.5 | Hazy | 19 |
| Ex. 24 | 0.9 | 0.2 | 4.5 | Hazy | 18 |
| Ex. 25 | 0.2 | 0.1 | 2 | Clear | 12 |
| Ex. 26 | 0.2 | 0.3 | 0.67 | Clear | 16 |
| Ex. 27 | 0.2 | 0.5 | 0.4 | Slightly Hazy | 14 |
| Ex. 28 | 0.2 | 0.7 | 0.29 | Slightly Hazy | 7.5 |
| Ex. 29 | 0.2 | 0.9 | 0.22 | Slightly Hazy | 17 |

As shown in Table 7, the exemplary compositions provide good foam performance and stability using various ratios of Siloxane Cationic Surfactants (A) and Organic Cationic Surfactants (B) (e.g. see examples 20-29). Loadings of Siloxane Cationic Surfactant (A) of at least 0.2 wt. % in the stabilizing compositions provide additional stability benefits to foams prepared therewith (e.g. see Examples 21-29).

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments. Any reference to elements in the singular, for example, using the articles "a," "an," "the," or "said," is not to be construed as limiting the element to the singular. Further, it is to be understood that the terms "right angle", "orthogonal", "perpendicular", and "parallel" are generally employed herein in a relative and not an absolute sense. Further, it will be appreciated that the terms "substantially", "about", "essentially", etc. indicate minor deviations of the property being modified. Such deviation may be of from 0-10%, alternatively of from 0-5%, alternatively of from 0-3% of a particular property.

Likewise, it is also to be understood that the appended claims are not limited to express and particular assemblies, systems, or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

Further, any ranges and subranges relied upon in describing various embodiments of the present invention independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present invention, and such ranges and subranges may be further delineated into relevant halves, thirds, quarters, fifths, and so on. As just one example, a range "of from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims, and may be relied upon individually and/or collectively and provide adequate support for specific embodiments within the scope of the appended claims. In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange of from at least 10 to 35, a subrange of from at least 10 to 25, a subrange of from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "of from 1 to 9" includes various individual integers, such as 3, as well as individual numbers including a decimal point (or fraction), such as 4.1, which may be relied upon and provide adequate support for specific embodiments within the scope of the appended claims.

What is claimed is:

1. A foam stabilizing composition, comprising:

(A) a siloxane cationic surfactant having general formula (I):

$$[Z^1\text{-}D^1\text{-}N(Y)_a(R)_{2-a}]^{+y}[X^{-x}]_n \quad \text{(I)},$$

wherein $Z^1$ is a siloxane moiety; $D^1$ is a divalent linking group; R is H or an unsubstituted hydrocarbyl group having from 1 to 4 carbon atoms; each Y has formula $\text{-D-NR}^1{}_3{}^+$, where D is a divalent linking group and each $R^1$ is independently an unsubstituted hydrocarbyl group having from 1 to 4 carbon atoms; subscript a is 1 or 2; $1 \le y \le 3$; X is an anion; subscript n is 1, 2, or 3; and $1 \le x \le 3$, with the proviso that $(x*n)=y$; and (B) an organic cationic surfactant having general formula (II):

$$[Z^2\text{-}D^2\text{-}N(Y)_b(R)_{2-b}]^{+y}[X^{-x}]_n \quad \text{(II)},$$

wherein $Z^2$ is an unsubstituted hydrocarbyl group; $D^2$ is a covalent bond or a divalent linking group; subscript b is 1 or 2; and each R, Y, superscript y, X, subscript n, and superscript x is independently selected and as defined above.

2. The foam stabilizing composition of claim 1, wherein the siloxane moiety $Z^1$ has the formula:

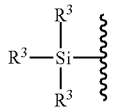

where each $R^3$ is independently selected from $R^2$ and $—OSi(R^4)_3$, with the proviso that at least one $R^3$ is $—OSi(R^4)_3$; where each $R^4$ is independently selected from $R^2$, $—OSi(R^5)_3$, and $—[OSiR^2{}_2]_mOSiR^2{}_3$; where each $R^5$ is independently selected from $R^2$, $—OSi(R^6)_3$, and $—[OSiR^2{}_2]_mOSiR^2{}_3$; where each $R^6$ is independently selected from $R^2$ and $—[OSiR^2{}_2]_mOSiR^2{}_3$;

where $0 \le m \le 100$; and where each $R^2$ is independently a substituted or unsubstituted hydrocarbyl group.

3. The foam stabilizing composition of claim 2, wherein each $R^3$ is $—OSi(R^4)_3$, where $R^4$ is independently selected and as defined above.

4. The foam stabilizing composition of claim 1, wherein the siloxane moiety $Z^1$ has one of the following structures (i)-(iv):

(i)

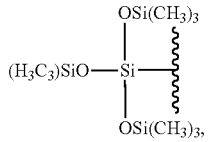

(ii)

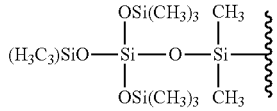

-continued (iii)

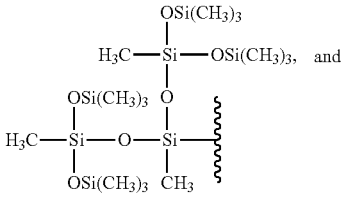

and (iv)

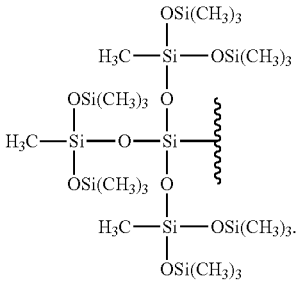

5. The foam stabilizing composition of claim 1, wherein: (i) $D^1$ is a branched or linear alkylene group; or (ii) $D^1$ has formula $-D^3-N(R^7)-D^3-$, where each $D^3$ is an independently selected divalent linking group and $R^7$ is H or Y, where Y is independently selected and as defined above.

6. The foam stabilizing composition of claim 5, wherein the divalent linking group $D^1$ has formula $-D^3-N(R^7)-D^3-$, where each $D^3$ and $R^7$ are as defined above, and wherein: (i) each $D^3$ is an independently selected alkylene group having from 1 to 8 carbon atoms; (ii) $R^7$ is H; or (iii) both (i) and (ii).

7. The foam stabilizing composition of claim 1, wherein in the siloxane cationic surfactant (A): (i) subscript a is 1; (ii) superscript y is 1; (iii) R is H; or (iv) any combination of (i)-(iii).

8. The foam stabilizing composition of claim 1, wherein $Z^2$ is an alkyl group having from 6 to 18 carbon atoms.

9. The foam stabilizing composition of claim 1, wherein $D^2$ is the covalent bond.

10. The foam stabilizing composition of claim 1, wherein $D^2$ is the divalent linking group, and wherein the divalent linking group $D^2$ comprises a branched or linear alkylene group.

11. The foam stabilizing composition of claim 10, wherein the divalent linking group $D^2$ has formula $-D^4-N(R^8)-D^4-$, where each $D^4$ is an independently selected divalent linking group and $R^8$ is H or Y, where Y is independently selected and as defined above.

12. The foam stabilizing composition of claim 11, wherein (i) each $D^4$ is an independently selected alkylene group having from 1 to 8 carbon atoms; (ii) $R^8$ is H; or (iii) both (i) and (ii).

13. The foam stabilizing composition of claim 1, wherein in the organic cationic surfactant (B): (i) subscript b is 1; (ii) superscript y is 1; (iii) R is H; or (iv) any combination of (i)-(iii).

14. The foam stabilizing composition of claim 1, wherein: (i) each $D^1$ is selected from $—CH_2CH(OH)CH_2—$ and $—HC(CH_2OH)CH_2—$; (ii) each $R^1$ is methyl; (iii) each X is Cl and superscript x is 1; or (iv) any combination of (i)-(iii).

15. The foam stabilizing composition of claim 1, comprising a weight ratio of the siloxane cationic surfactant (A) to the organic cationic surfactant (B) of from 1:10 to 10:1 (A:B).

16. The foam stabilizing composition of claim 1, further comprising at least one additive selected from: (C) solvents; (D) surfactants other than components (A) and (B); (E) rheology modifiers; (F) pH control agents; and (G) foam enhancers.

17. An aqueous film-forming foam comprising the foam stabilizing composition of claim 1.

18. A method of extinguishing a fire comprising contacting the fire with the aqueous film-forming foam of claim 17.

* * * * *